US007980663B2

(12) United States Patent
Matsumoto et al.

(10) Patent No.: US 7,980,663 B2
(45) Date of Patent: Jul. 19, 2011

(54) LIQUID EJECTION HEAD

(75) Inventors: Mitsuhiro Matsumoto, Yokohama (JP); Keiji Tomizawa, Yokohama (JP); Shuichi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 12/545,478

(22) Filed: Aug. 21, 2009

(65) Prior Publication Data

US 2010/0053277 A1 Mar. 4, 2010

(30) Foreign Application Priority Data

Aug. 29, 2008 (JP) ..... 2008-222769

(51) Int. Cl.
*B41J 2/14* (2006.01)
*B41J 2/05* (2006.01)

(52) U.S. Cl. ..... 347/47; 347/65; 347/63; 347/40; 347/56

(58) Field of Classification Search ..... 347/63, 347/64, 65, 47, 56, 40
See application file for complete search history.

(56) References Cited

U.S. PATENT DOCUMENTS

| | | | | |
|---|---|---|---|---|
| 6,520,626 | B1 | 2/2003 | Murakami | |
| 6,971,736 | B2 * | 12/2005 | Tomizawa et al. | 347/61 |
| 6,984,026 | B2 | 1/2006 | Tomizawa et al. | |
| 7,506,962 | B2 | 3/2009 | Murakami et al. | |
| 2004/0218007 | A1 | 11/2004 | Tomizawa et al. | |
| 2007/0206065 | A1 | 9/2007 | Tomizawa et al. | |
| 2009/0058933 | A1 | 3/2009 | Matsumoto et al. | |
| 2009/0058934 | A1 | 3/2009 | Matsumoto | |
| 2009/0058949 | A1 | 3/2009 | Tomizawa et al. | |
| 2009/0066753 | A1 | 3/2009 | Matsumoto | |
| 2009/0147056 | A1 | 6/2009 | Oikawa et al. | |

FOREIGN PATENT DOCUMENTS

| | | |
|---|---|---|
| CN | 1485206 A | 3/2004 |
| JP | 54-161935 | 12/1979 |
| JP | 61-185455 | 8/1986 |
| JP | 61-249768 | 11/1986 |
| JP | 4-010940 | 1/1992 |
| JP | 4-010941 | 1/1992 |

OTHER PUBLICATIONS

Chinese Office Action dated Dec. 17, 2010 in corresponding Chinese patent application and English translation.

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A print head can improve an ink refill speed to reduce the time from the end of one ejection of ink droplets until the beginning of a next ejection of ink droplets and maintain the high quality of images obtained by printing. An ink jet print head has an ejection port portion including a first ejection port portion communicating with atmosphere, and a second ejection port portion having a cross-section which extends in a direction orthogonal to an ejecting direction and which is larger than that of the first ejection port portion. The second ejection port portion is formed between a bubbling chamber and the first ejection port portion. In the ink jet print head, an ejection port portion first axis is located away from an ejection port portion second axis.

4 Claims, 21 Drawing Sheets

LIQUID EJECTION HEAD

BACKGROUND OF THE INVENTION

1. Field of the Invention

The present invention relates to a liquid ejection head ejecting droplets, and in particular, to improvements in the stability of droplets ejected by the liquid ejection head.

2. Description of the Related Art

Many proposed printing apparatuses include ink jet printing apparatuses based on a drop-on-demand scheme. These ink jet printing apparatuses apply kinetic energy to droplets to eject the droplets, which impact a print medium for printing. The ink jet printing apparatuses thus have the advantage of being capable of printing on various print media according to this scheme. The ink jet printing apparatuses further have the advantage of eliminating the need for special processing for fixing ink and allowing high-definition images to be inexpensively obtained. Because of these advantages, the ink jet printing apparatuses based on the drop-on-demand scheme as a printing scheme have been commonly adopted in households and offices as means for outputting image documents. This printing scheme is inexpensively and easily available and is used as printing means for printers, copiers, facsimile machines, and the like, which serve as peripheral apparatuses for computers.

Typical ink ejection methods (ink ejection energy generating elements) for the common ink jet printing scheme include a method using electrothermal conversion elements, for example, heaters, and a method using piezoelectric elements, for example, piezo elements. Any of these methods allows ejection of ink droplets to be controlled according to electric signals. The ink ejection method using electrothermal conversion elements applies a voltage to each of the electrothermal conversion elements to instantaneously boil ink located near the electrothermal conversion element. During the boiling, the phase of the ink changes to rapidly increase a bubbling pressure, allowing ink droplets to be quickly ejected. On the other hand, the ink ejection method using piezoelectric elements applies a voltage to each of the piezoelectric elements to displace the piezoelectric element. During the displacement, a pressure is generated to eject ink droplets. Ejection methods using a print head with electrothermal conversion elements are disclosed in Japanese Patent Laid-Open No. S54-161935 (1979), Japanese Patent Laid-Open No. S61-185455 (1986), Japanese Patent Laid-Open No. S61-249768 (1986), Japanese Patent Laid-Open No. H4-10940 (1992) and Japanese Patent Laid-Open No. H4-10941 (1992).

The ink ejection method using electrothermal conversion elements is more advantageous, in the following point, than the methods utilizing other means such as piezoelectric elements. The former method does not require a large space for installation of elements for printing, enabling nozzles to be integrated together and allowing a reduction in the size of the print head.

To increase the print speed of the ink jet printing apparatus and to further improve image quality, it is necessary to achieve an increase in the number of ink ejections per unit time, a further reduction in the size of ink droplets, and stabilization of the ejection of ink droplets. The number of ink ejections is equal to the driving frequency of a voltage applied to the electrothermal conversion elements. However, the driving frequency decreases consistently with the frequency (hereinafter referred to as a refill frequency) at which ink is refilled from a supply chamber into an ejection port portion and a bubbling chamber.

To allow ink to be continuously ejected, the following operation is performed. After ink is ejected through an ejection port, new ink is refilled into the ejection port portion and the bubbling chamber. The electrothermal conversion elements are then driven again to eject the new ink. At this time, if a long time is required for ink refilling following the ejection of ink droplets, a long time elapses until the next ejection of ink droplets. This makes the printing operation unavailable for a long time, resulting in a long time required for the printing.

Increasing the refill frequency requires a reduction in the flow resistance of the ejection port portion. However, in this case, a simple increase in the diameter of the ejection port increases the size of ejected droplets. This prevents high-definition images from being obtained. This is because the ink jet printing apparatus combines ink droplets in various colors to form an image, so that the size of ink droplets has a close relationship with image quality.

Thus, to improve the ink refill speed in the print head, the print head may be formed such that the ejection port portion has a first ejection port portion and a second ejection port portion provided between the bubbling chamber and the first ejection port portion and having a larger diameter than the first ejection port portion. This enables a reduction in variation in channel width in the ejection port portion and thus in the flow resistance of the ink to ink ejected from the bubbling chamber via the ejection port portion. Thus, the speed at which ink is refilled after the ejection of ink droplets can be increased with the high quality of print images maintained. As a result, the time required for refilling can be reduced.

However, even if the second ejection port portion having the larger diameter than the first ejection port portion is formed between the first ejection port portion and the bubbling chamber to increase the refill speed, the stability of ink ejection from the print head may be inappropriate. The ejection stability as used herein refers to whether the mass or speed of ejected ink droplets or the accuracy of impact on the print medium can be maintained constant even when high quality printing is performed at high speed, that is, even when ink is continuously ejected. There are many possible causes for the instability of ejections. A major cause is meniscus vibration.

After droplets are ejected by the print head for printing, an amount of ink corresponding to the ejection is refilled in the bubbling chamber. At this time, the ink flows into the bubbling chamber and the ejection port portion at a certain velocity. FIG. 21A shows plan view of a nozzle in this condition. FIG. 21B is a sectional view of the nozzle. During ink refilling, the ink is filled into the print head so that the flow velocity of the ink is maximized in a substantially central portion of the ejection port portion as shown in FIG. 21B.

However, upon reaching the ejection port portion, the ink is subjected to the force of the atmospheric pressure and the surface tension acting in a direction opposite to that of the flow. On the ink inside the ejection port portion, an inertia force acts in the direction of the ink flow, whereas the atmospheric pressure and surface tension act in the opposite direction. Thus, during ink filling, vibration (hereinafter referred to as meniscus vibration) occurs around the ejection port surface. If the surface of the ink vibrates during ink ejection, the position of the surface is unstable, and the ink is unstably ejected by the print head. This makes the size of ejected ink droplets unstable and reduces the impact accuracy.

When the ink is ejected while the shape of the ink surface is unstable because of the meniscus vibration, that is, while the surface of the ink is raised or recessed with respect to the ejection port surface, the amount of ink droplets ejected may vary. This may in turn vary the dot diameter of ink droplets, which is an element for formation of images. As a result, the image quality may be degraded.

Furthermore, if the ink flows fast to the ejection port portion and the inertia force of the ink is higher than the atmospheric pressure or the surface tension of the ink itself, the amplitude of the meniscus vibration may increase to cause the ink to overflow the ejection port. The ink may then adhere to the surface of the ejection port, thus reducing the impact accuracy. In this phenomenon, smaller ejected ink droplets are more likely to be affected by the adhering ink. The resulting reduced impact accuracy may degrade the quality of print images.

Therefore, to allow ink droplets to be continuously and stably ejected, the ink is desirably ejected at time intervals such that the meniscus vibration is attenuated sufficiently to stabilize the ink surface. However, if new ink ejection is not started until the meniscus vibration is attenuated to stabilize the ink surface, printing requires a long time, thus reducing the efficiency with which images are formed by the printing.

SUMMARY OF THE INVENTION

In view of the above-described circumstances, an object of the present invention is to provide a liquid ejection head that improves the ink refill speed to reduce the time from the end of ejection of ink droplets until the beginning of next ejection of ink droplets, the liquid ejection head maintaining the high quality of images obtained by printing.

According to an aspect of the present invention, there is provided a liquid ejection head comprising: an energy acting chamber in which a heating element generating heat energy utilized to eject a liquid through an ejection port is arranged, and an ejection port portion communicating with the energy acting chamber and including the ejection port, wherein the ejection port portion has a first ejection port portion including the ejection port and a second ejection port portion having a cross section extending in a orthogonal direction orthogonal to an ejecting direction in which the liquid is ejected, the cross section being larger than that of the first ejection port portion, the second ejection port portion being formed between the energy acting chamber and the first ejection port portion, wherein an ejection port portion first axis passing through a center of gravity of a cross section of the first ejection port portion, the cross section extending in the orthogonal direction, the ejection port portion first axis extending in the ejecting direction, is located away from an ejection port portion second axis passing through a center of gravity of a cross section of the second ejection port portion, the cross section located closest to the first ejection port portion in the ejecting direction, the cross section extending in the orthogonal direction, the ejection port portion second axis extending in the ejecting direction.

According to the present invention, after droplets are ejected for printing and a new liquid is then refilled, possible meniscus vibration is inhibited. The present invention can thus provide a liquid ejection head that can stably eject droplets.

Further features of the present invention will become apparent from the following description of exemplary embodiments (with reference to the attached drawings).

DESCRIPTION OF THE EMBODIMENTS

Specific embodiments of the present invention will be described below in detail with reference to the drawings.

First Embodiment

Figure 1A:
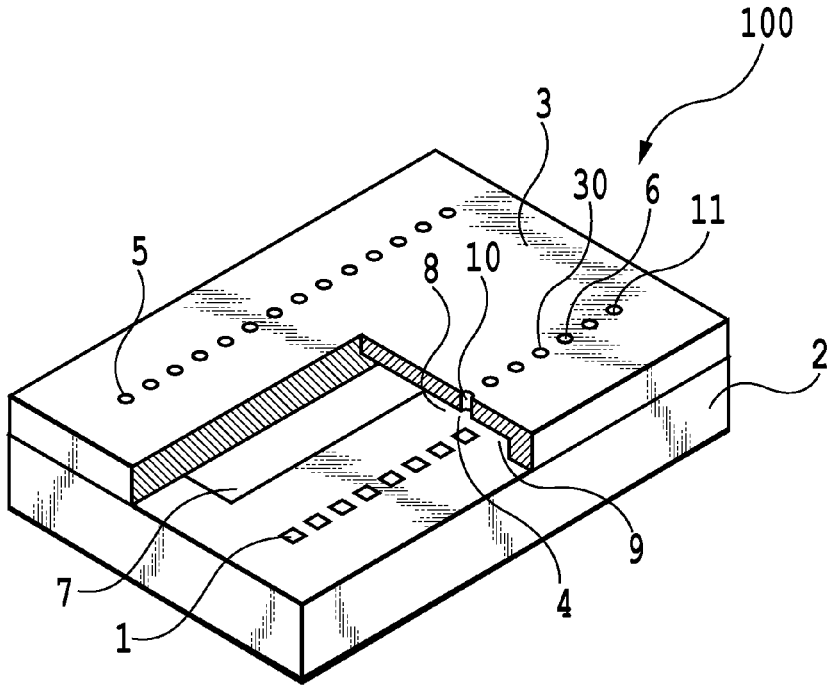
FIG. 1A is a perspective view of a print head according to an embodiment of the present invention.
Figure 1B:
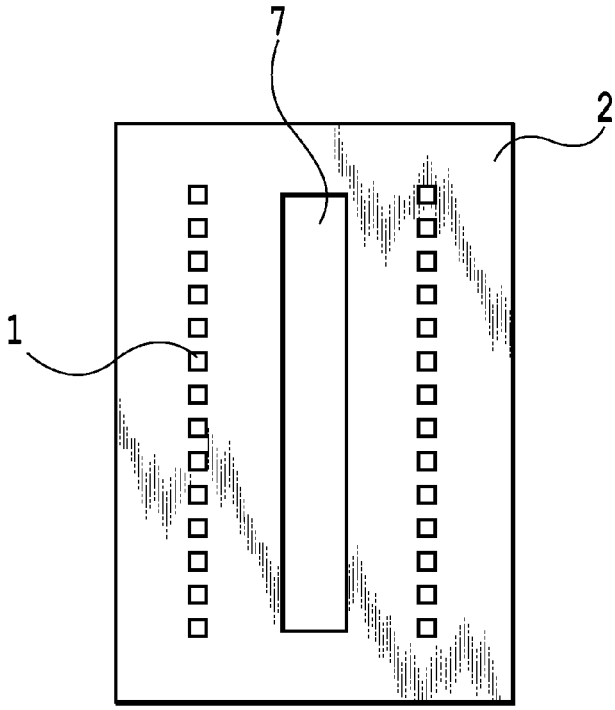
FIG. 1B is a plan view of the print head with a channel forming substrate removed therefrom.

First, the configuration of an ink jet print head 100 as a liquid ejection head according to a first embodiment of the present invention will be described. FIG. 1A is a partly broken perspective view of the ink jet print head 100 according to the first embodiment of the present invention. FIG. 1B is a plan view showing the ink jet print head 100 with a channel forming substrate 3 removed therefrom.

The ink jet print head 100 includes an element substrate 2 with electrothermal conversion elements 1 provided therein, and a channel forming substrate (orifice substrate) 3 stacked on and joined to the principal surface of the element substrate 2 so as to form a plurality of ink channels.

The element substrate 2 is formed of, for example, glass, ceramics, resin, metal, or the like; the element substrate 2 is generally formed of Si. The electrothermal conversion elements 1, electrodes (not shown in the drawings), and wires (not shown in the drawings) are provided on the principal surface of the element substrate 2 for each ink channel; the electrothermal conversion elements 1 serve as heating elements, the electrodes apply voltages to the electrothermal conversion elements 1, and the wires are connected to the electrodes and laid in a predetermined wiring pattern. Furthermore, an insulating layer (not shown in the drawings) improving dissipation of accumulated heat is provided on the principal surface of the element substrate 2 so as to cover the electrothermal conversion elements 1. Upon receiving an applied electric signal, the electrothermal conversion elements 1 generate heat energy utilized to eject ink. Additionally, a protect film (not shown in the drawings) is provided on the principal surface of the element substrate 2 so as to cover the insulating film; the protect film protects the element substrate 2 from cavitation resulting from the disappearance of bubbles.

The channel forming substrate 3 has a plurality of nozzles 4 through which ink flows. Each of the nozzles 4 has a supply chamber 7 and a supply path 8 for ink supply, a bubbling chamber 9 in which ink is boiled to generate bubbles and which serves as an energy acting chamber, and an ejection port portion 10 including an ejection port 30 that is a tip opening of the nozzle 4, through which ink droplets are ejected. The ejection port portion 10 is formed over the element substrate 2 opposite the corresponding electrothermal conversion element 1, so as to communicate with the bubbling chamber 9.

The channel forming substrate 3 includes a first nozzle row 5 having a plurality of the electrothermal conversion elements 1 and a plurality of the nozzles 4 arrayed in line, and a second nozzle row 6 positioned opposite the first nozzle row 5 across the supply chamber 7 and having a plurality of the electrothermal conversion elements 1 and a plurality of the nozzles 4 the longitudinal directions of which are arrayed parallel to one another. The first and second nozzle rows 5 and 6 are formed such that the distance between the adjacent nozzles corresponds to a pitch of 600 to 1,200 dpi. The nozzles 4 in the second nozzle row 6 are staggered with respect to the nozzles 4 in the first nozzle row 5 so that the pitch between the adjacent nozzles 4 in the second nozzle row 6 is offset, by half pitch, from the pitch between the adjacent nozzles 4 in the first nozzle row 5.

The ink as a liquid is fed from the ink supply chamber 7 and filled into the bubbling chamber 9 and the ejection port portion 10 via the ink supply path 8. An ink supply port 13 as a liquid supply port is formed between the ink supply chamber 7 and the ink supply path 8. For printing, electric energy is applied to the electrothermal conversion element 1, which instantaneously boils the surrounding ink. This changes the gas-liquid phase of the ink to rapidly increase a bubbling pressure. As a result, ink droplets are quickly ejected through the ejection port 10.

The present embodiment uses the print head in which after droplets are ejected and before bubbles disappear, the bubbles communicate with outside air. Thus, droplets are ejected for printing by the print head in which before disappearing to cause cavitation, the bubbles have communicated with the outside air. This reduces the frequency at which cavitation occurs as a result of the disappearance of bubbles. Consequently, the durability of the electrothermal conversion element 1 is improved. Furthermore, an ink jet printing apparatus with such a print head mounted therein can be used to increase the amount from which the ink in the ejection port portion and bubbling chamber is ejected during a single ejection operation. This reduces the amount of ink remaining in the bubbling chamber, enabling a reduction in variation in ink ejection amount caused by a rise in the temperature of the ink in the bubbling chamber. Therefore, images of higher definition are obtained.

The nozzle structure of the ink jet print head, which is a main component of the present invention, will be described below in detail with reference to the drawings.

Figure 2A:
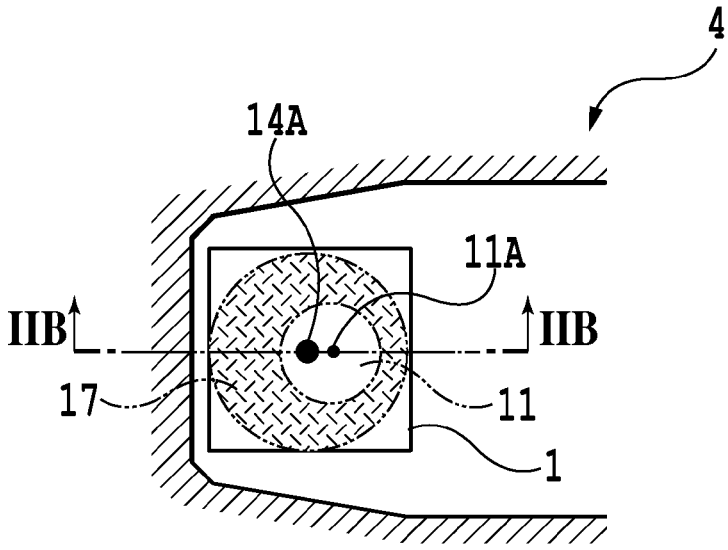
FIG. 2A is an enlarged plan view of a nozzle portion of the print head in FIG. 1.
Figure 2B:
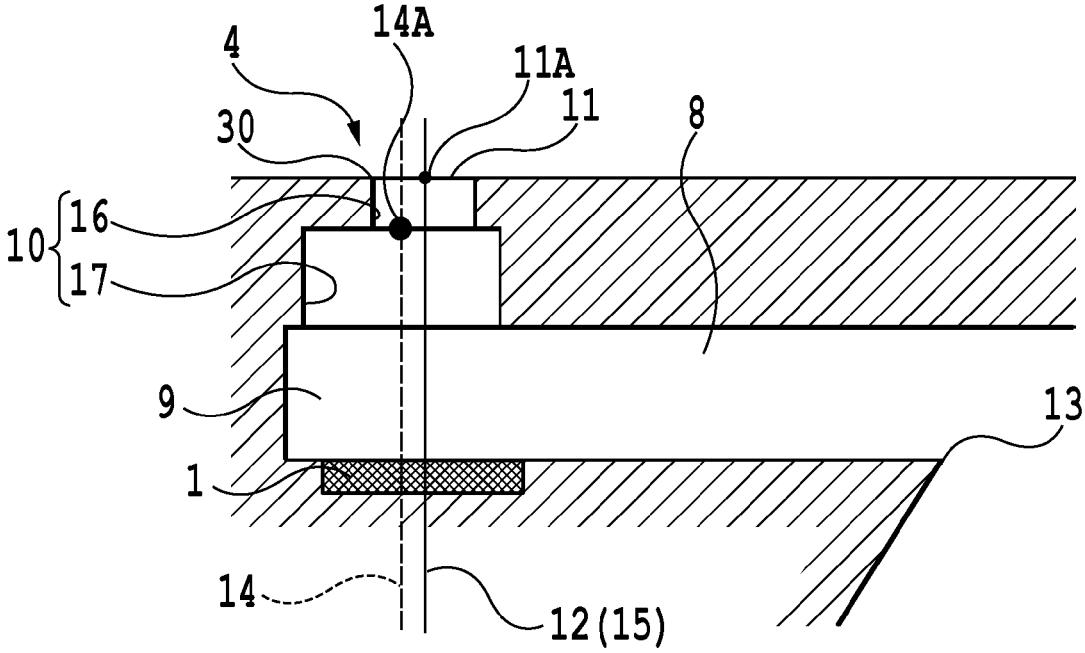
FIG. 2B is a sectional view taken along line IIB-IIB in FIG. 2A.

FIG. 2A is an enlarged plan view of the nozzle portion of the ink jet print head according to the first embodiment. FIG. 2B is a sectional view taken along line IIB-IIB in FIG. 2A.

The shape of the nozzle shown in FIGS. 2A and 2B is such that a first ejection port portion 16 and a second ejection port portion 17 are each formed to be cylindrical. In the present embodiment, the ejection port portion 10 is formed to have the first ejection port portion 16 including an ejection port 30 and the second ejection port portion 17 located between the first ejection port portion 16 and the bubbling chamber 9. An area of cross section of the second ejection port portion 17 extending in a direction orthogonal to the direction in which the ink is ejected is larger than the first ejection port portion 16. A direction which is orthogonal to the principal surface of the substrate and in which the ink as a liquid is ejected is hereinafter referred to as an "ejecting direction". A direction orthogonal to the ejecting direction is hereinafter referred to as an "orthogonal direction". The nozzle shaped as described above reduces variation in channel width in the ejection port portion 10. This enables a reduction in flow resistance. Thus, the refill speed can be improved without the need to change the diameter of ejected ink droplets. Consequently, printing can be efficiently performed with high print quality maintained. Here, the cross section of the first ejection port portion 16 and second ejection port portion 17 as viewed in the ink ejecting direction is not limited to a circle but may be any other shape such as an ellipse or a polygon.

Here, an axis extending in the ejecting direction through the center of gravity of a cross section of the first ejection port portion extending in the orthogonal direction is hereinafter referred to as an ejection port portion first axis 12. An axis extending in the ejecting direction through the center of gravity of a cross section of the second ejection port portion 17 extending in the orthogonal direction is hereinafter referred to as an ejection port portion second axis 14; the cross section is located in a portion of the second ejection port portion 17 closest to the first ejection port portion 16 in the ejecting direction. In the present embodiment, as shown in FIGS. 2A and 2B, the ejection port portion first axis 12 passes through the center of gravity 11A of a first ejection port portion upper end surface 11 and intersects perpendicularly with the principal surface of the element substrate 2. In the present embodiment, the ejection port portion second axis 14 passes through the center of gravity 14A of a second ejection port portion upper end surface and intersects perpendicularly with the principal surface of the element substrate 2. In the print head, the ejection port portion first axis 12 and the ejection port portion second axis 14 are arranged away from each other. In the present embodiment, the ejection port portion second axis 14 is located away from the ejection port portion first axis 12 toward an opposite side from a location of the ink supply port 13, through which the ink is supplied to the bubbling chamber 9.

An axis passing through the center of gravity of a cross section of the electrothermal conversion element 1 extending in the direction orthogonal to the ejecting direction as a heater element axis is hereinafter referred to as a heater axis 15. In the present embodiment, the ejection port portion first axis 12 coincides with the heater axis 15 passing through the center of gravity of a cross section of the electrothermal conversion element 1 which faces the bubbling chamber 9 and intersecting perpendicularly with the principal surface of the element substrate.

In the present embodiment, the ejection port portion first axis 12 coincides with the heater axis 15. Thus, the first ejection port portion 16 is formed at the position corresponding to the electrothermal conversion element 1. Thus, when an electric signal is applied to the electrothermal conversion element 1 and film boiling occurs in the ink surrounding the electrothermal conversion element 1, bubbles are formed at a position corresponding to the first ejection port portion 16, and are not arranged away from the first ejection port portion 16. Consequently, the bubbling pressure generated inside the bubbling chamber 9 acts evenly on the first ejection port portion 16. Ejected ink droplets then flow evenly (axially symmetrically) with respect to the ejection port portion first axis 12. Thus, ejected ink droplets and satellite droplets thereof are prevented from deflecting, thus maintaining high impact accuracy.

Furthermore, in the present embodiment, the ejection port portion first axis 12 and the ejection port portion second axis 14 are located away from each other. Thus, the ink supplied during refilling following the ejection of ink droplets flows so as not to correspond to the ejection port portion first axis 12. The ink flows in this case will be described with reference to FIGS. 3A and 3B.

Figure 3A:
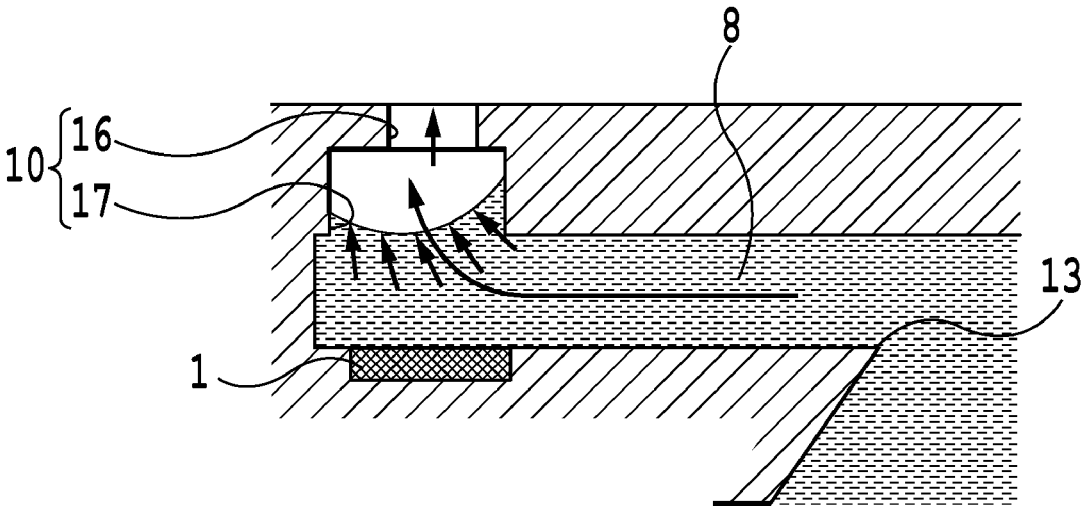
FIGS. 3A and 3B are diagrams illustrating ink refilling performed after ink droplets have been ejected by the print head in FIGS. 2A and 2B.
Figure 3B:
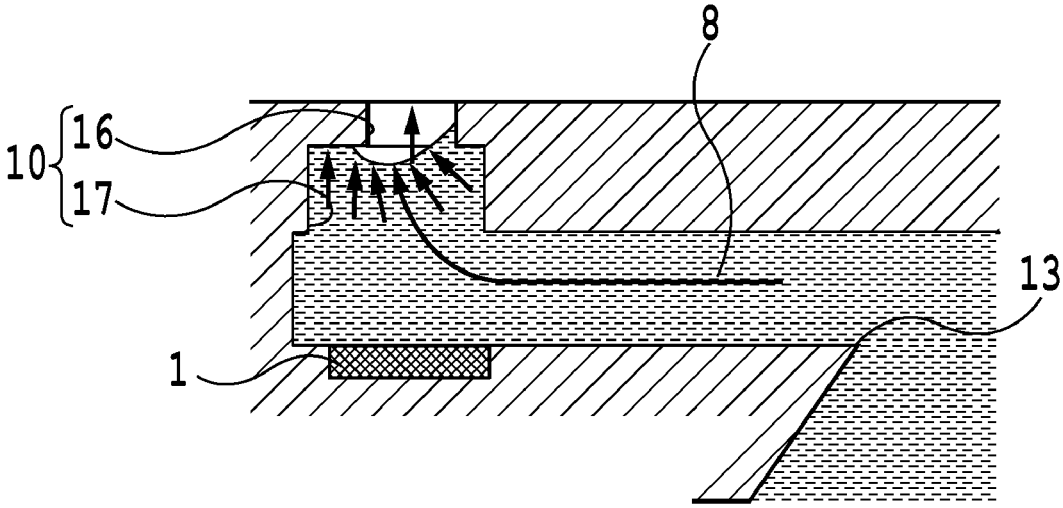

FIGS. 3A and 3B are sectional views for illustrating ink flows inside the nozzle during ink refilling following the ejection of ink droplets. When ink droplets are ejected through the ejection port portion 10, new ink is refilled into the bubbling chamber 9 as shown in FIG. 3A. Thereafter, new ink is also refilled into the ejection port portion 10 as shown in FIG. 3B. Finally, the whole nozzle is refilled with the ink. Arrows shown inside the ink supply path 8 and the bubbling chamber 9 in FIGS. 3A and 3B show portions of the ink flows exhibiting the maximum flow velocity. In the present embodiment, during refilling, the ink flows so as not to correspond to the ejection port portion first axis 12. Thus, the maximum flow velocity portion of each of the ink flows moves away from the center of the first ejection port portion 16. If the maximum flow velocity portion of the ink flow collides against an area in which the first ejection port portion 16 is not formed rather than against the inside of the first ejection port portion, the ink flow collides against the second ejection port portion or the wall surface of the bubbling chamber. Thus, no large ink flow is generated inside the first ejection port portion 16. Furthermore, since the second ejection port portion 17 internally has a larger channel width, the kinetic momentum of the ink flow is absorbed therein to reduce the flow velocity of the ink flow. This allows a reduction in meniscus vibration upon completion of refilling.

Additionally, even if the ejection port portion second axis 14 is located at a relatively small distance from the ejection port portion first axis 12, and the maximum flow velocity portion of the ink flow flows through the first ejection port portion 16, the maximum flow velocity portion flows relatively close to the wall surface of the first ejection port portion 16 rather than through the center of the first ejection port portion 16. Consequently, the flow velocity of the ink flow is reduced by a friction with wall surface. As a result, the ink flow velocity during refilling is reduced. This allows a reduction in meniscus vibration upon completion of refilling.

Furthermore, as shown in FIGS. 3A and 3B, the ejection port portion second axis 14 is located away from the ejection port portion first axis toward the opposite side of the ink supply port 13, through which ink is supplied to the bubbling chamber 9. When the ejection port portion second axis 14 is thus located away from the ejection port portion first axis toward the opposite side of the ink supply port 13, the position where the ink flows into the first ejection port portion 16 is more easily displaced from the center of the first ejection port portion 16. Thus, the flow velocity of the ink flowing into the ejection port portion 10 is more easily absorbed in the second ejection port portion 17. This allows a reduction in meniscus vibration in the surface of the ink refilled into the ejection port portion 10; the vibration may occur particularly at the surface of the ejection port.

Thus, the print head according to the present embodiment enables a reduction in the flow velocity of the ink flow during refilling following the ejection of ink droplets. This in turn enables a reduction in meniscus vibration when the refilling is completed. Consequently, when the ejection of ink droplets is followed by refilling, the meniscus vibration in the ink surface is reduced, thus allowing ink droplets to be ejected with the ink surface kept stable. Therefore, during printing, the size and impact position of ink droplets are prevented from being affected by the meniscus vibration. This allows the high quality of images obtained by the printing to be maintained. Furthermore, if the meniscus vibration in the ink surface is waited out until the meniscus vibration is reduced, the time elapsing until the meniscus vibration attenuates sufficiently to stabilize the ink surface is reduced. This reduces the time required for printing, allowing the printing to be efficiently performed in a short time.

Second Embodiment

Now, a second embodiment in which the present invention is implemented will be described. Components of the second embodiment similar to corresponding ones of the above-described first embodiment will not be described. Only differences from the first embodiment will be described.

Figure 4A:
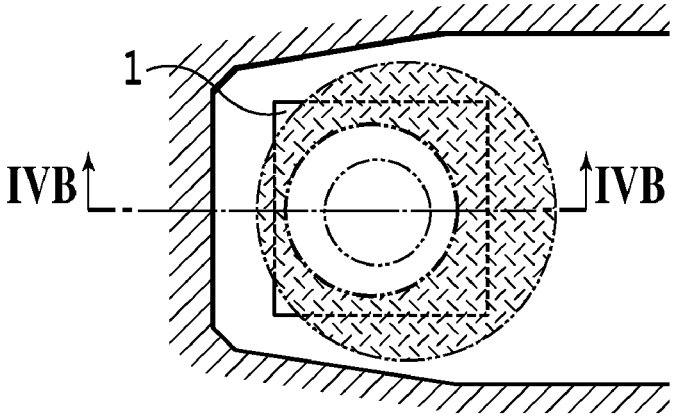
FIG. 4A is an enlarged plan view of a nozzle portion of a print head according to a second embodiment of the present invention.
Figure 4B:
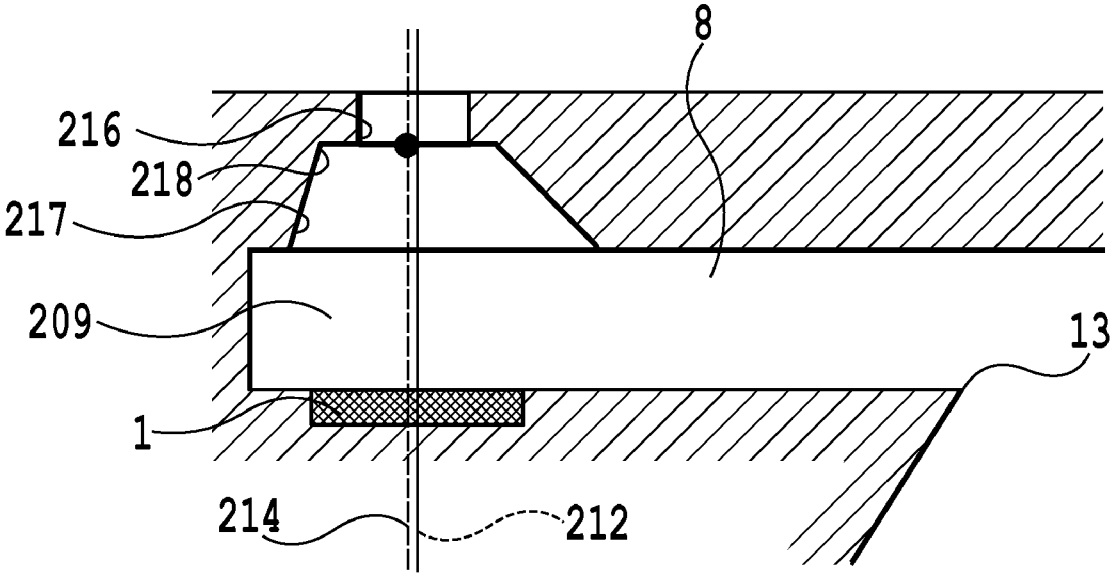
FIG. 4B is a sectional view taken along line IVB-IVB in FIG. 4A.

FIG. 4A is a plan view of a nozzle according to the second embodiment. FIG. 4B is a sectional view of the nozzle in FIG. 4A taken along line IVB-IVB. The nozzle shape according to the second embodiment shown in FIGS. 4A and 4B is different from that according to the first embodiment in that a first ejection port portion 216 is shaped like a cylinder and a second ejection port portion 217 is shaped like a truncated cone. The second ejection port portion 217 shaped like a truncated cone further reduces variation in the width of the ink channel compared to the second ejection port portion in the first embodiment. This enables a further reduction in flow resistance to ink flows when ink is ejected. Furthermore, the tapered side surface of the second ejection port portion 217 reduces an area in which ink stagnates.

Ink remaining in the stagnant area continues to absorb part of heat generated by the electrothermal conversion element 1 and is thus likely to become hotter than ink in the other areas. This changes the viscosity of the ink and thus viscosity resistance during ejection. Thus, the characteristics of ejected droplets may become unstable to affect print images.

In the present embodiment, the nozzle is formed so as to reduce the ink stagnant area such as wall surfaces present in the print head according to the first embodiment and intersect perpendicularly with each other. This prevents the ink from becoming hot, thus stabilizing the ejection amount and ejection speed and maintaining the high quality of images obtained by printing.

Furthermore, in the print head according to the second embodiment shown in FIGS. 4A and 4B, an ejection port portion second axis 214 passing through the center of gravity of a second ejection port upper end surface is located away from an ejection port portion first axis 212 toward the opposite side of the ink supply port 13. On the other hand, the lower end of the second ejection port portion 217 is widened toward the ink supply port 13. In the present embodiment, the lower end of the second ejection port portion 217 is widened toward the ink supply port 13 to reduce the distance over which the ink flows from the ink supply chamber 7 to the ejection port portion. This increases the refill speed to improve the refill frequency.

Third Embodiment

Now, a third embodiment in which the present invention is implemented will be described. Components of the third embodiment similar to corresponding ones of the above-described first and second embodiments will not be described. Only differences from the first and second embodiments will be described.

Figure 5A:
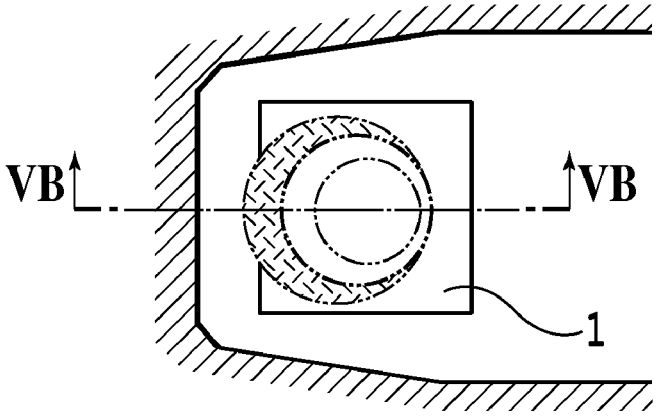
FIG. 5A is an enlarged plan view of a nozzle portion of a print head according to a third embodiment of the present invention.
Figure 5B:
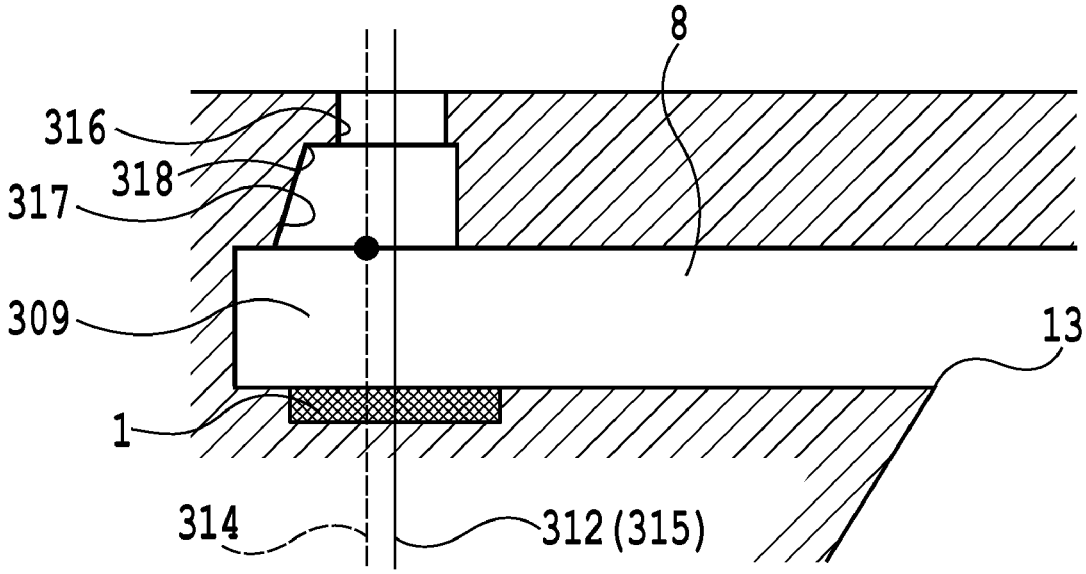
FIG. 5B is a sectional view taken along line VB-VB in FIG. 5A.

FIG. 5A is a plan view of a nozzle according to the third embodiment. FIG. 5B is a sectional view of the nozzle in FIG. 5A taken along line VB-VB. In the third embodiment shown in FIGS. 5A and 5B, an ejection port portion second axis (not shown in the drawings) passing through a center of gravity of a cross section of an upper end surface of a second ejection port portion 317 extending in the orthogonal direction is located away from the an ejection port portion first axis 312 passing through the center of gravity of a cross section of a first ejection port portion 316 extending in the orthogonal direction. In addition, in the present embodiment, the ejection port portion first axis 312 is located away from an ejection port portion third axis 314 passing through the center of gravity of a cross section of an area of the second ejection port portion 317 other than the area closest to the first ejection port portion which cross section extends in the orthogonal direction. The axis passing through the center of gravity of the cross section of the area of the second ejection port portion 317 other than the area closest to the first ejection port portion which cross section extends in the orthogonal direction is hereinafter referred to as the ejection port portion third axis. In the present embodiment, in particular, the ejection port portion first axis 312 is located away from the ejection port portion third axis 314 passing through the center of gravity of a cross section of a portion of the second ejection port portion 317 which is closest to the bubbling portion 309 with respect to the ejecting direction; the cross section extends in the orthogonal direction.

As described above, the nozzle is formed such that the ejection port portion third axis 314 passes through the center of gravity of a cross section of the second ejection port portion 317 which is closer to the lower end thereof and such that in a portion of the second ejection port portion which is closer to the lower end thereof, the ejection port portion third axis 314 is located farther from the ejection port portion first axis 312. Here, the portion closer to the lower end means a portion close to the bubbling chamber 309. For ink flows, the central position of the ink flow is preferably located away from the center of gravity of the first ejection port portion 316 in the portion of the second ejection port portion 317 at a position closer to the bubbling chamber 309. This is because in this case, when the ink flows from the second ejection port portion 317 into the first ejection port portion 316, the maximum flow velocity portion of the ink flow flows through a position located far away from the center of the first ejection port portion 316. Thus, inside the first ejection port portion 316, the maximum flow velocity portion of the ink flow flows through a position located far away from the center of the first ejection port portion 316. This allows a more effective reduction in meniscus vibration upon completion of refilling.

Fourth Embodiment

Now, a fourth embodiment in which the present invention is implemented will be described. Components of the fourth embodiment similar to corresponding ones of the above-described first to third embodiments will not be described. Only differences from the first to third embodiments will be described.

Figure 6A:
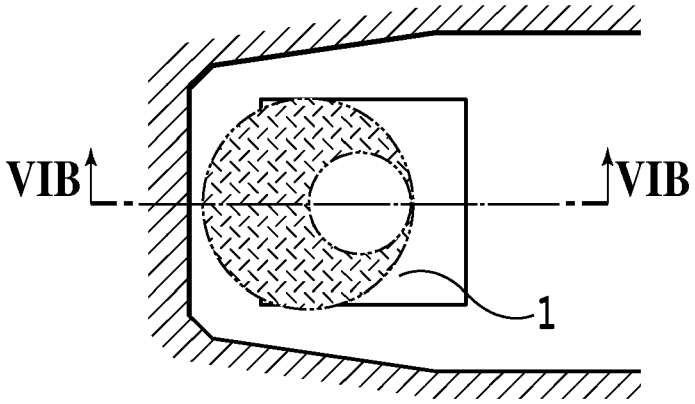
FIG. 6A is an enlarged plan view of a nozzle portion of a print head according to a fourth embodiment of the present invention.
Figure 6B:
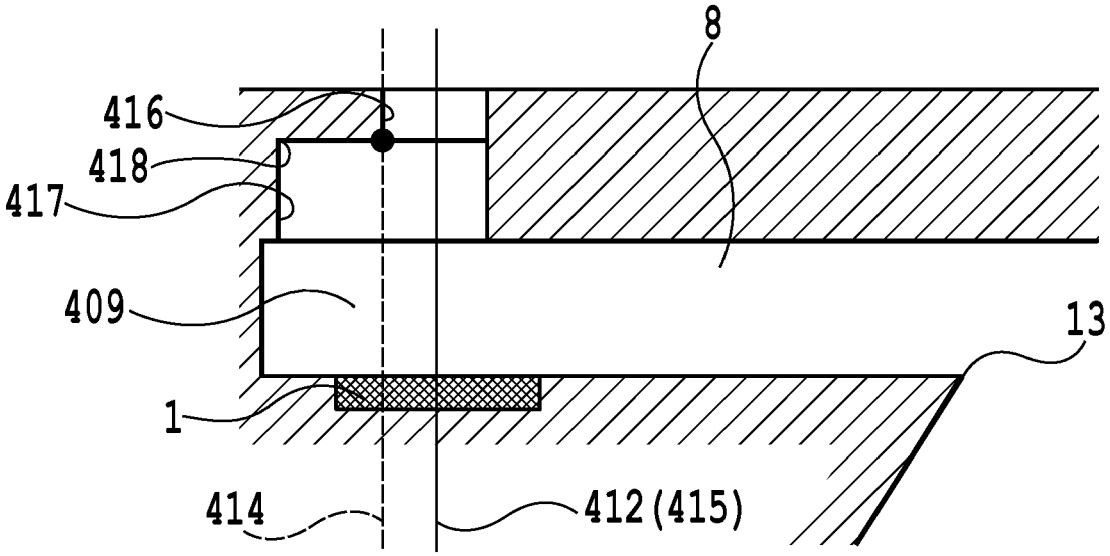
FIG. 6B is a sectional view taken along line VIB-VIB in FIG. 6A.

FIG. 6A is a plan view of a nozzle according to the fourth embodiment. FIG. 6B is a sectional view of the nozzle in FIG. 6A taken along line VIB-VIB. The nozzle according to the fourth embodiment shown in FIGS. 6A and 6B is shaped such that a first ejection port portion 416 and a second ejection port portion 417 are both formed like a cylinder. The nozzle is also formed such that a portion in which the wall surfaces in the first ejection port portions 416 and the second ejection port portions 417 intersect perpendicularly is smaller on the ink supply port 13 side. The print head according to the fourth embodiment thus involves a reduced ink stagnant area in the second ejection port portion compared to that according to the first embodiment. This reduces the adverse effect of a rise in the temperature of the ink.

Fifth Embodiment

Now, a fifth embodiment in which the present invention is implemented will be described. Components of the fifth embodiment similar to corresponding ones of the above-described first to fourth embodiments will not be described. Only differences from the first to fourth embodiments will be described.

Figure 7A:
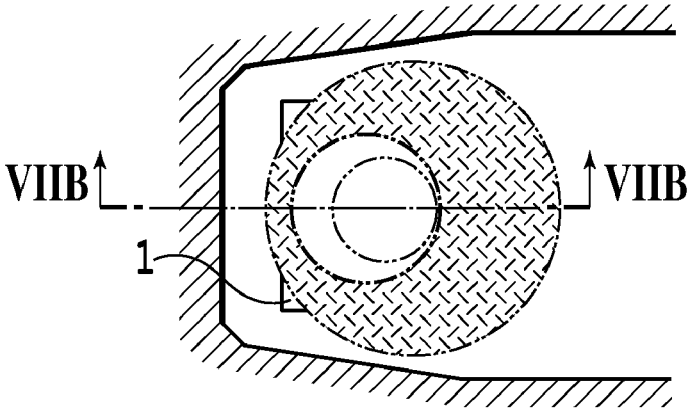
FIG. 7A is an enlarged plan view of a nozzle portion of a print head according to a fifth embodiment of the present invention.
Figure 7B:
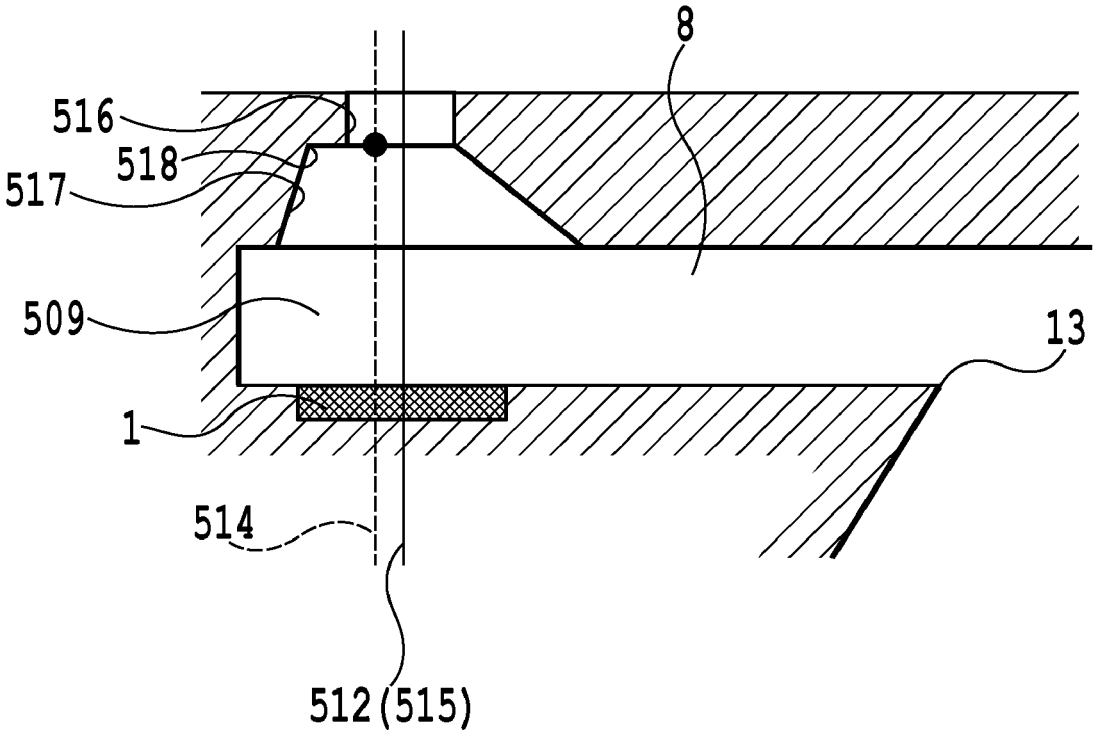
FIG. 7B is a sectional view taken along line VIIB-VIIB in FIG. 7A.

FIG. 7A is a plan view of a nozzle according to the fifth embodiment. FIG. 7B is a sectional view of the nozzle in FIG. 7A taken along line VIIB-VIIB. The nozzle according to the fifth embodiment shown in FIGS. 7A and 7B is shaped such that a first ejection port portion 516 is shaped like a cylinder and a second ejection port portion 517 is shaped like a truncated cone. The nozzle is formed such that no portions of the wall surfaces intersect perpendicularly with each other on the ink supply port 13 side in the first ejection port portion 516 and the second ejection port portion 517. As described in the second embodiment, the second ejection port portion 517 shaped like a truncated cone reduces the ink stagnant area compared to the second ejection port portion 517 shaped like a cylinder. This enables a possible increase in the temperature of the ink in the stagnant area to be inhibited, thus allowing variation in ejection amount caused by the possible temperature rise to be prevented. Thus, the possible degradation of the quality of print images can be prevented. Furthermore, the lower end of the second ejection port portion 517 is widened toward the ink supply port 13. This reduces the resistance to the ink to increase the refill frequency.

Sixth Embodiment

Now, a sixth embodiment in which the present invention is implemented will be described. Components of the sixth embodiment similar to corresponding ones of the above-described first to fifth embodiments will not be described. Only differences from the first to fifth embodiments will be described.

Figure 8A:
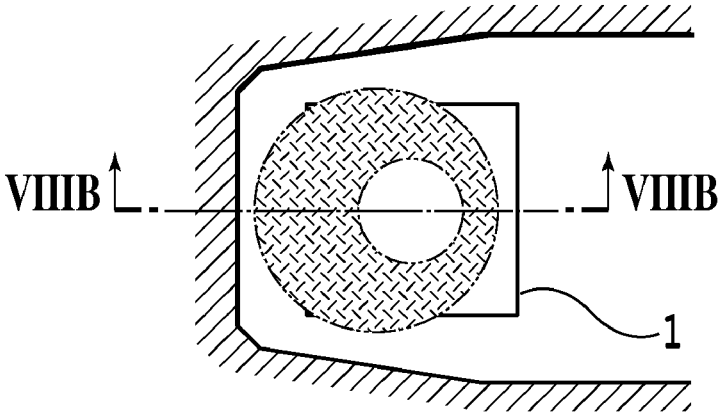
FIG. 8A is an enlarged plan view of a nozzle portion of a print head according to a sixth embodiment of the present invention.
Figure 8B:
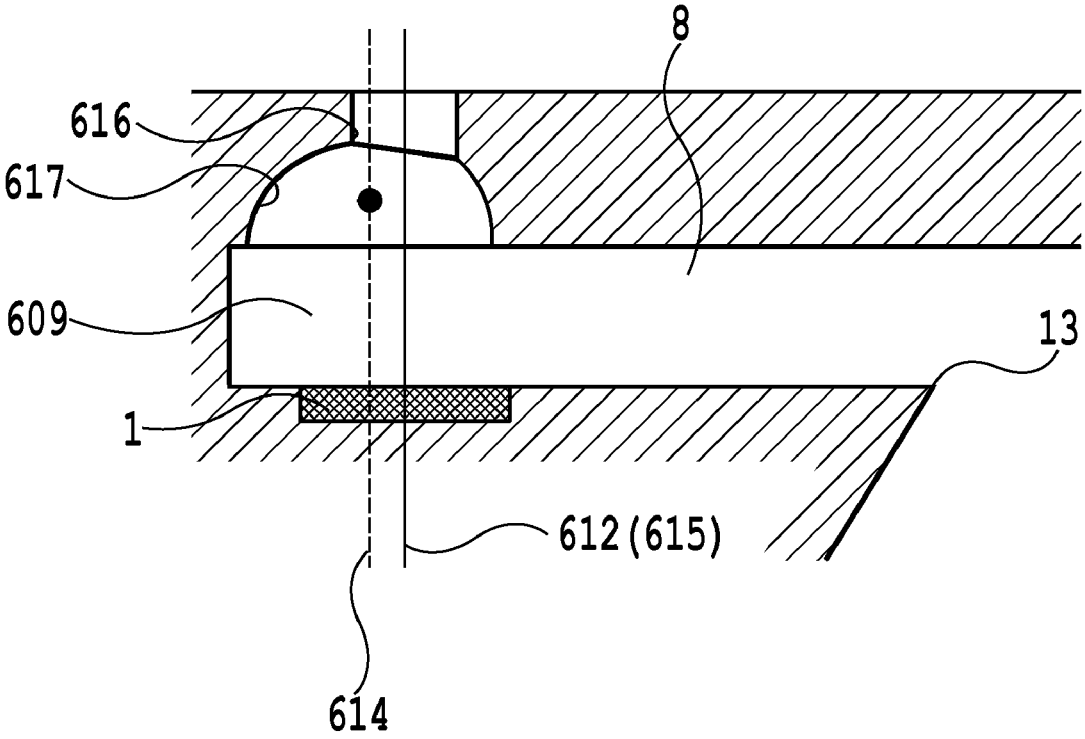
FIG. 8B is a sectional view taken along line VIIIB-VIIIB in FIG. 8A.

FIG. 8A is a plan view of a nozzle according to the sixth embodiment. FIG. 8B is a sectional view of the nozzle in FIG. 8A taken along line VIIIB-VIIIB. The nozzle according to the sixth embodiment shown in FIGS. 8A and 8B is shaped such that a first ejection port portion 616 is shaped like a cylinder and a second ejection port portion 617 is shaped like a part of a sphere. Thus, the second ejection port portion 617 may be shaped like a partly cut sphere or an oval sphere. The nozzle is formed like such shape, the stagnant area is reduced in the second ejection port portion 617. Thus, a rise in the temperature of ink which is likely to occur in the stagnant area can be inhibited. This allows variation in ejection amount caused by the possible temperature rise to be inhibited. Consequently, the possible degradation of the quality of print images can be prevented.

Furthermore, in the present embodiment, an ejection port portion second axis (not shown in the drawings) passing through a cross section of the upper end surface of the second ejection port portion 617 which cross section extends in the orthogonal direction is located away from an ejection port portion first axis 612 passing through the center of gravity of a cross section of the first ejection port portion 616 extending in the orthogonal direction. In the present embodiment, in addition, an ejection port portion third axis 614 passes through the center of gravity of a cross section of a portion of the second ejection port portion 617 which is not the upper end surface or lower end surface thereof; the cross section extends in the orthogonal direction. The nozzle is also formed such that the ejection port portion third axis 614 is located away from the ejection port portion first axis 612. The ejection port portion third axis 614 passes through the center of gravity of a cross section of the second ejection port portion 617 which is closer to the lower end thereof. As the ejection port portion third axis 614 is located farther from the ejection port portion first axis 612, the maximum flow velocity portion of the ink flow flows though a position located farther from the center of the first ejection port portion 616. This allows a correspondingly effective reduction in meniscus vibration upon completion of refilling. Thus, the nozzle is preferably formed such that the center of gravity of the cross section of the lower end surface of the second ejection port portion 617 is located far away from the ejection port portion first axis 612. However, as is the case with the present embodiment, the center of gravity may be set on a cross section of the second ejection port portion 617 which extends in the direction orthogonal to the ink ejecting direction and which is not the lower end surface thereof so that the ejection port portion third axis 614 passing through the center of gravity is located away from the ejection port portion first axis 612.

Seventh Embodiment

Now, a seventh embodiment in which the present invention is implemented will be described. Components of the seventh embodiment similar to corresponding ones of the above-described first to sixth embodiments will not be described. Only differences from the first to sixth embodiments will be described.

Figure 9A:
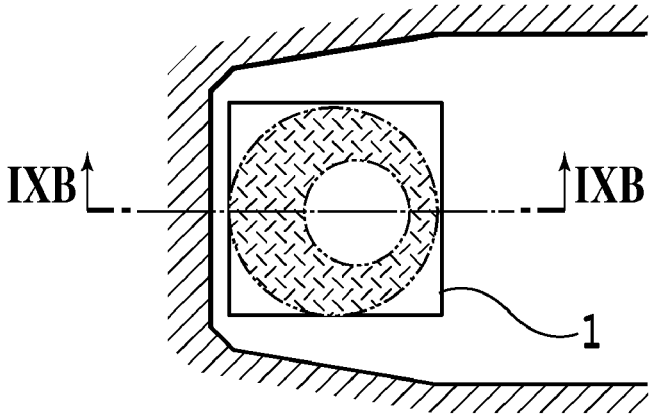
FIG. 9A is an enlarged plan view of a nozzle portion of a print head according to a seventh embodiment of the present invention.
Figure 9B:
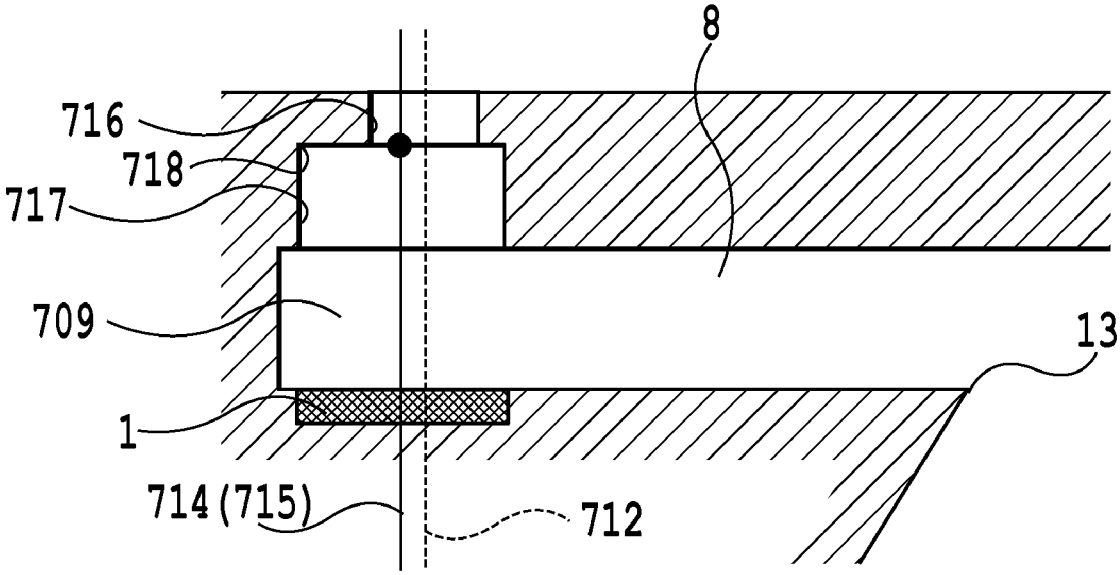
FIG. 9B is a sectional view taken along line IXB-IXB in FIG. 9A.

FIG. 9A is a plan view of a nozzle according to the seventh embodiment. FIG. 9B is a sectional view of the nozzle in FIG. 9A taken along line IXB-IXB. The print head according to the present embodiment is different from those according to the first to sixth embodiments in that an ejection port portion second axis 714 coincides with a heater axis 715.

In the present embodiment, the nozzle is shaped such that the ejection port portion second axis 714 is located away from an ejection port portion first axis 712 toward the opposite side of the ink supply port 13 and such that the heater axis 715 coincides with the ejection port portion second axis 714. Thus, advantageously, a bubbling pressure generated by the electrothermal conversion element 1 is evenly transmitted to the second ejection port portion 717. Consequently, during ejection, ink droplets can sufficiently receive bubbling energy. Therefore, the print head according to the present embodiment allows ink droplets to be efficiently ejected with a reduced amount of power.

As shown in FIGS. 9A and 9B, in the present embodiment, a first ejection port portion 716 and the second ejection port portion 717 are each shaped like a cylinder.

Eighth Embodiment

Now, an eighth embodiment in which the present invention is implemented will be described. Components of the eighth embodiment similar to corresponding ones of the above-described first to seventh embodiments will not be described. Only differences from the first to seventh embodiments will be described.

Figure 10A:
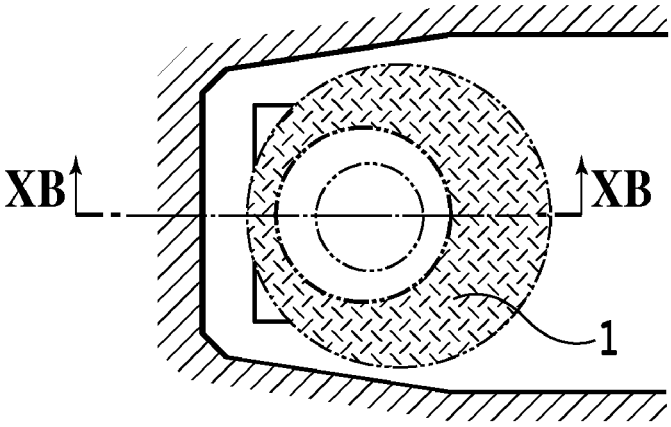
FIG. 10A is an enlarged plan view of a nozzle portion of a print head according to an eighth embodiment of the present invention.
Figure 10B:
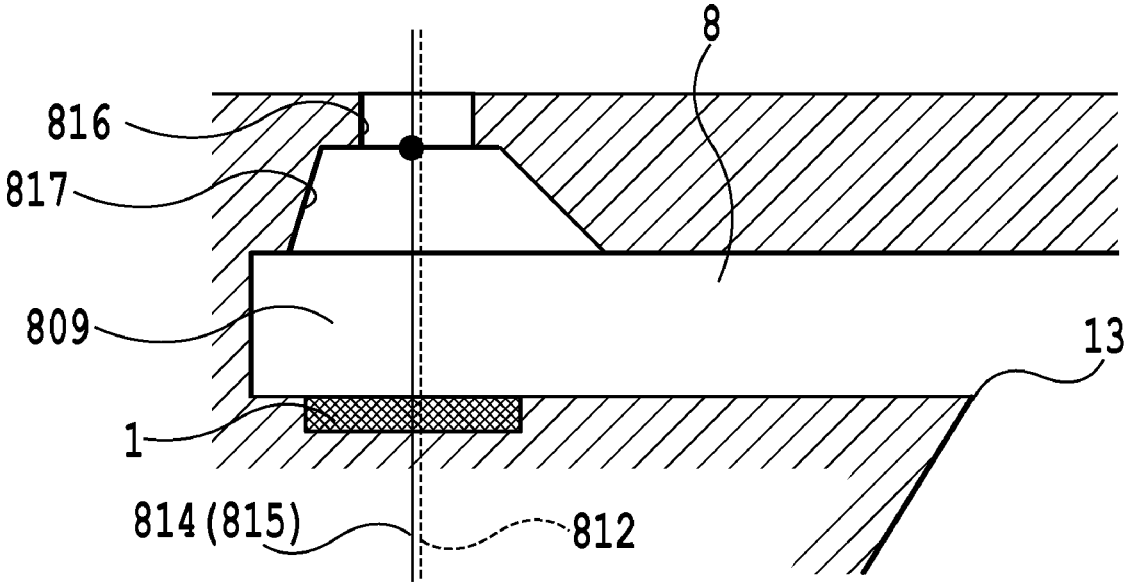
FIG. 10B is a sectional view taken along line XB-XB in FIG. 10A.

FIG. 10A is a plan view of a nozzle according to the eighth embodiment. FIG. 10B is a sectional view of the nozzle in FIG. 10A taken along line XB-XB. The nozzle according to the eighth embodiment shown in FIGS. 10A and 10B is shaped such that a first ejection port portion 816 is shaped like a cylinder and a second ejection port portion 817 is shaped like a truncated cone. The nozzle according to the eighth embodiment formed such that the second ejection port portion 817 is shaped like a truncated cone, the nozzle thus enables a further reduction in flow resistance compared to that according to the seventh embodiment. Furthermore, the tapered side surface of the second ejection port portion 817 reduces the resistance to ink flows and the ink stagnant area. This stabilizes the ejection amount and speed, thus improving the quality of print images. This is because the ink stagnating in the stagnant area is heated by the electrothermal conversion element 1 and becomes hotter than the surrounding ink, thus varying the viscosity resistance to the ink to be ejected to affect ejection characteristics.

In the eighth embodiment shown in FIGS. 10A and 10B, an ejection port portion second axis 814 passing through the center of gravity of the upper end surface of the second ejection port portion 817 is located away from an ejection port portion first axis 812 toward the opposite side of the ink supply port 13. On the other hand, the lower end of the second ejection port portion 817 is widened toward the ink supply port 13. Since the lower end of the second ejection port portion 817 is widened toward the ink supply port 13, the distance over which the ink flows from the ink supply port 13 to the ejection port portion is reduced. The possible meniscus vibration is thus inhibited. This structure also improves the refill frequency during refilling in the nozzle in the print head.

Ninth Embodiment

Now, a ninth embodiment in which the present invention is implemented will be described. Components of the ninth embodiment similar to corresponding ones of the above-described first to eighth embodiments will not be described. Only differences from the first to eighth embodiments will be described.

Figure 11A:
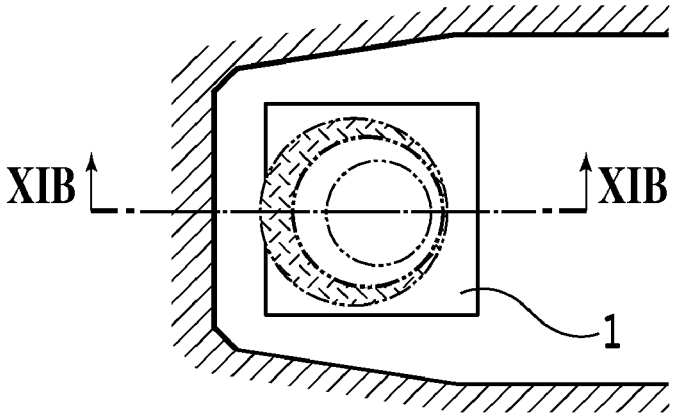
FIG. 11A is an enlarged plan view of a nozzle portion of a print head according to a ninth embodiment of the present invention.
Figure 11B:
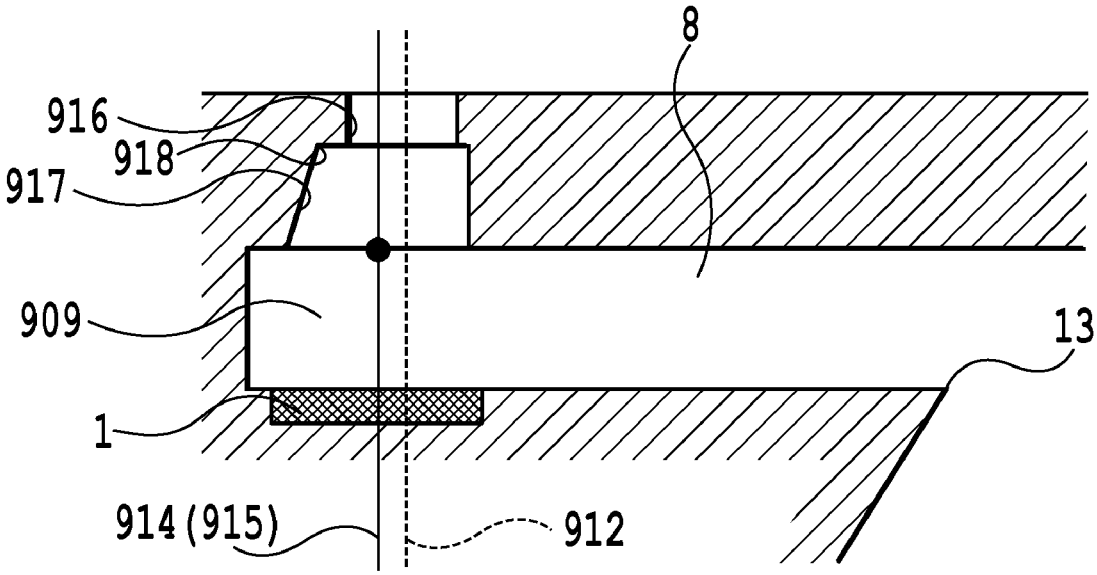
FIG. 11B is a sectional view taken along line XIB-XIB in FIG. 11A.

FIG. 11A is a plan view of a nozzle according to the ninth embodiment. FIG. 11B is a sectional view of the nozzle in FIG. 11A taken along line XIB-XIB. In the present embodiment, an ejection port portion second axis 917 (not shown in the drawings) passing through a cross section of the upper end surface of the second ejection port portion which cross section extends in the orthogonal direction is located away from an ejection port portion first axis 912 passing through the center of gravity of a cross section of a first ejection port portion 916 which cross section extends in the orthogonal direction. In the present embodiment, in addition, an ejection port portion third axis 914 passing through the center of gravity of the lower end surface of the second ejection port portion 917 is located away from the ejection port portion first axis 912 toward the opposite side of the ink supply port 13. Furthermore, in the present embodiment, the nozzle is formed such that the ejection port portion third axis 914 coincides with a heater axis 915. The ejection port portion third axis 914 passes through the center of gravity of the cross section of the second ejection port portion 917 which is closer to the lower end thereof. As the ejection port portion third axis 914 is located farther from the ejection port portion first axis 912, the maximum flow velocity portion of the ink flow flows through a position located farther from the center of the first ejection port portion 916. Thus, the velocity at which the ink flows into the first ejection port portion 916 can be reduced. This allows a correspondingly effective reduction in meniscus vibration upon completion of refilling.

Tenth Embodiment

Now, a tenth embodiment in which the present invention is implemented will be described. Components of the tenth embodiment similar to corresponding ones of the above-described first to ninth embodiments will not be described. Only differences from the first to ninth embodiments will be described.

Figure 12A:
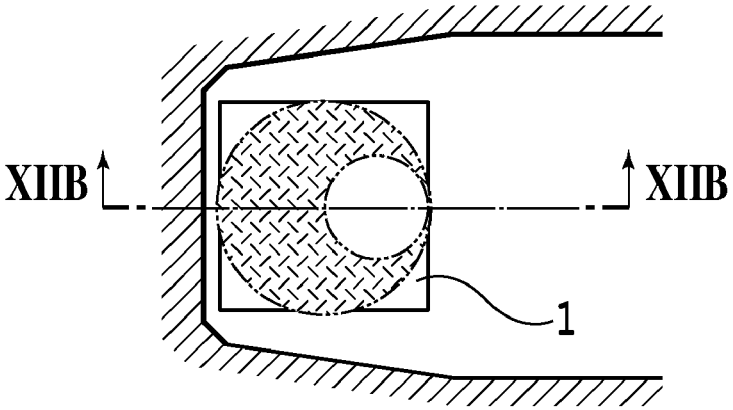
FIG. 12A is an enlarged plan view of a nozzle portion of a print head according to a tenth embodiment of the present invention.
Figure 12B:
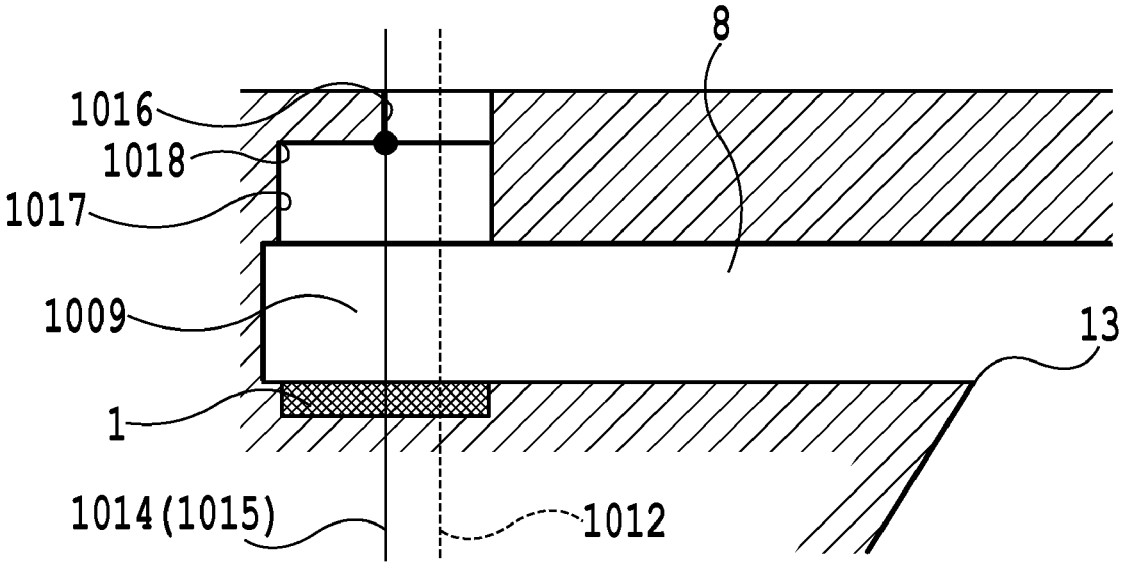
FIG. 12B is a sectional view taken along line XIIB-XIB in FIG. 12A.

FIG. 12A is a plan view of a nozzle according to the tenth embodiment. FIG. 12B is a sectional view of the nozzle in FIG. 12A taken along line XIIB-XIIB. The nozzle according to the tenth embodiment shown in FIGS. 12A and 12B is shaped such that a first ejection port portion 1016 and a second ejection port portion 1017 are both formed like a cylinder. The nozzle is formed such that a portion 1018 in which the wall surfaces in the first and second ejection port portions 1016 and 1017 intersect perpendicularly with each other is smaller on the ink supply port 13 side. This results in a relatively small ink stagnant area in the second ejection port portion 1017, thus reducing the effect of a rise in the temperature of the ink.

Eleventh Embodiment

Now, an eleventh embodiment in which the present invention is implemented will be described. Components of the eleventh embodiment similar to corresponding ones of the above-described first to tenth embodiments will not be described. Only differences from the first to tenth embodiments will be described.

Figure 13A:
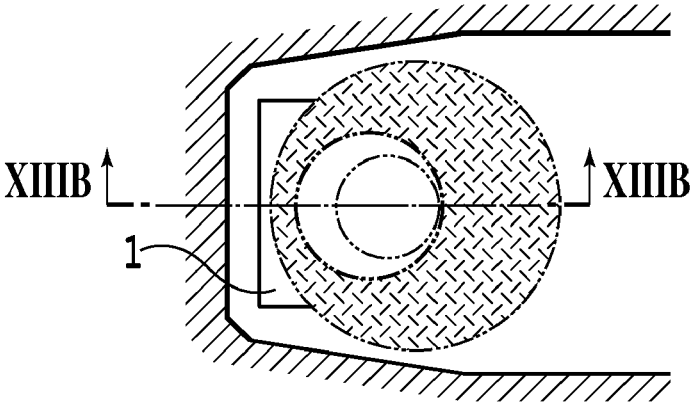
FIG. 13A is an enlarged plan view of a nozzle portion of a print head according to an eleventh embodiment of the present invention.
Figure 13B:
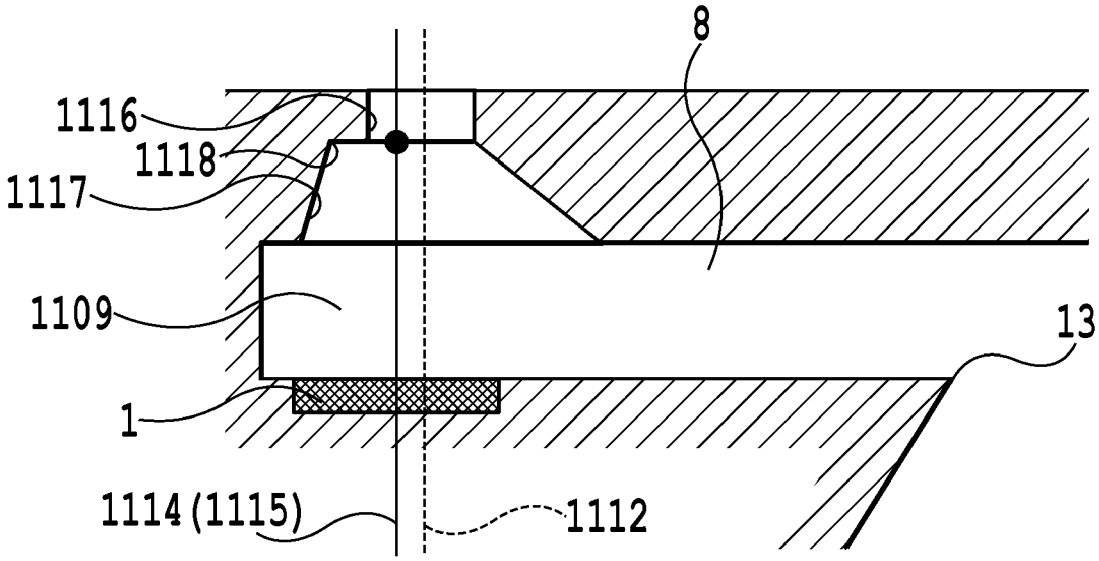
FIG. 13B is a sectional view taken along line XIIIB-XIIIB in FIG. 13A.

FIG. 13A is a plan view of a nozzle according to the eleventh embodiment. FIG. 13B is a sectional view of the nozzle in FIG. 13A taken along line XIIIB-XIIIB. The nozzle shown in FIGS. 13A and 13B is shaped such that a first ejection port portion 1116 is shaped like a cylinder and a second ejection port portion 1117 is shaped like a truncated cone. The nozzle is formed such that a portion 1118 in which the wall surfaces in the first and second ejection port portions 1116 and 1117 intersect perpendicularly with each other is smaller on the ink supply port 13 side. The second ejection port portion 1117 shaped like a truncated cone reduces the ink stagnant area compared to the second ejection port portion 1117 shaped like a cylinder. The present embodiment can thus inhibit possible improper printing such as variation in ejection amount which is caused by a rise in the temperature of the ink in the stagnant area. Furthermore, the lower end of the second ejection port portion 1117 is widened toward the ink supply port 13. This increases the refill frequency.

Twelfth Embodiment

Now, a twelfth embodiment in which the present invention is implemented will be described. Components of the twelfth embodiment similar to corresponding ones of the above-described first to eleventh embodiments will not be described. Only differences from the first to eleventh embodiments will be described.

Figure 14A:
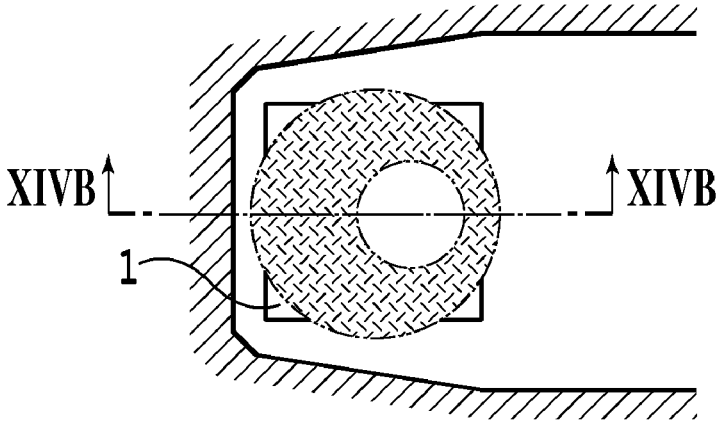
FIG. 14A is an enlarged plan view of a nozzle portion of a print head according to a twelfth embodiment of the present invention.
Figure 14B:
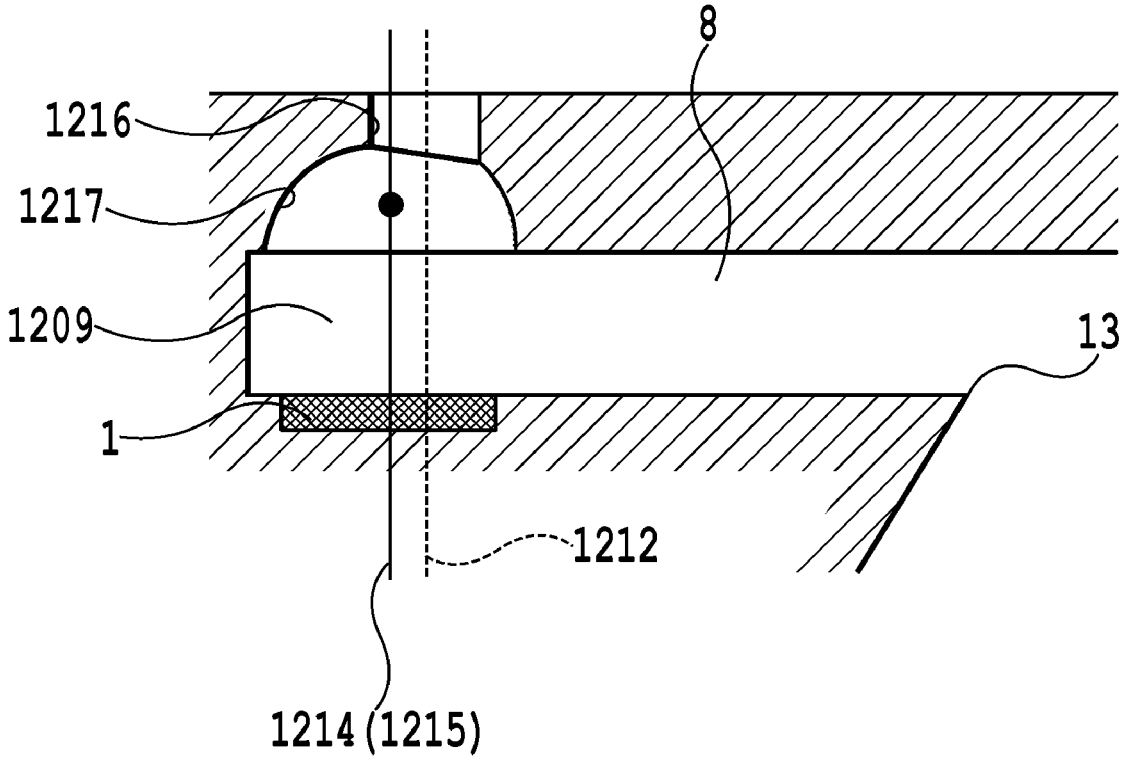
FIG. 14B is a sectional view taken along line XIVB-XIVB in FIG. 14A.

FIG. 14A is a plan view of a nozzle according to the twelfth embodiment. FIG. 14B is a sectional view of the nozzle in FIG. 14A taken along line XIVB-XIVB. The nozzle shown in FIGS. 14A and 14B is shaped such that a first ejection port portion 1216 is shaped like a cylinder and a second ejection port portion 1217 is shaped like a part of a sphere. Thus, the second ejection port portion 1217 may be shaped like a sphere or a partly cut oval sphere. The nozzle formed like such shape reduces the stagnant area in the second ejection port portion 1217. Thus, a rise in the temperature of ink which is likely to occur in the stagnant area can be inhibited. This allows variation in ejection amount caused by the possible temperature rise to be inhibited. Consequently, the possible degradation of the quality of print images can be prevented. Furthermore, an ejection port portion second axis (not shown in the drawings) passing through a center of gravity of a cross section of the upper end surface of the second ejection port portion 1217 which cross section extends in the orthogonal direction is located away from an ejection port portion first axis 1212 passing through the center of gravity of a cross section of the first ejection port portion 1216 in which the cross section extends in the orthogonal direction. In the present embodiment, the nozzle is additionally formed such that the ejection port portion third axis 1214 passes through the center of gravity of a cross section of the second ejection port portion 1217 which is closer to the lower end thereof and is thus located away from the ejection port portion first axis 1212. Thus, inside the first ejection port portion 1216, the maximum flow velocity portion of the ink flow flows through a position located farther from the center of the first ejection port portion 1216. Thus, the velocity at which the ink flows into the first ejection port portion 1216 can be reduced. This allows a correspondingly effective reduction in meniscus vibration upon completion of refilling. The cross section of the second ejection port portion 1217 extending in the direction orthogonal to the ink droplet ejecting direction and on which the center of gravity is set need not be the lower end surface. The cross section may correspond to a portion of the second ejection port portion 1217 which is relatively close to the lower end thereof, as in the case of the present embodiment.

Thirteenth Embodiment

Now, a thirteenth embodiment in which the present invention is implemented will be described. Components of the thirteenth embodiment similar to corresponding ones of the above-described first to twelfth embodiments will not be described. Only differences from the first to twelfth embodiments will be described.

Figure 15A:
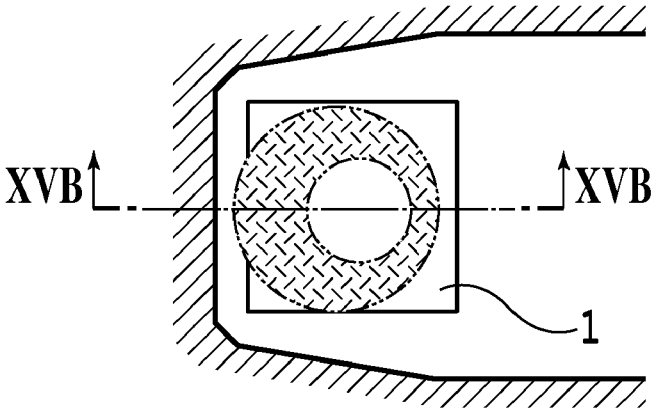
FIG. 15A is an enlarged plan view of a nozzle portion of a print head according to a thirteenth embodiment of the present invention.
Figure 15B:
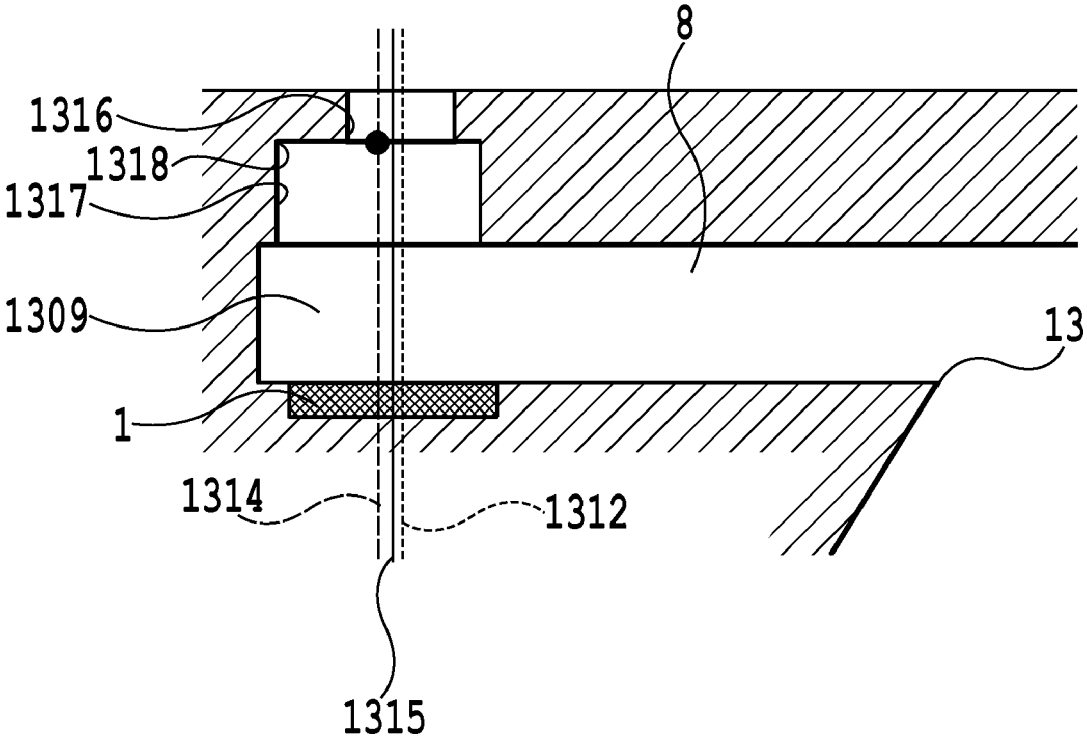
FIG. 15B is a sectional view taken along line XVB-XVB in FIG. 15A.

FIG. 15A is a plan view of a nozzle according to the thirteenth embodiment. FIG. 15B is a sectional view of the nozzle in FIG. 15A taken along line XVB-XVB. The print head according to the present embodiment is different from those according to the above-described embodiments in that an ejection port portion first axis 1312 is located away from a heater axis 1315 toward the ink supply port 13, whereas an ejection port portion second axis 1314 is located away from the heater axis 1315 toward the opposite side of the ink supply port 13. That is, the heater axis 1315 is positioned between the ejection port portion first axis 1312 and the ejection port portion second axis 1314 in a direction from the ink ejection port 13, through which the ink is supplied to the bubbling chamber 1309, toward the electrothermal conversion element 1. Thus, in the present embodiment, the print head is formed such that the ejection port portion first axis 1312 and the ejection port portion second axis 1314 are located relatively far from each other without lying relatively far from the heater axis 1315.

The relationship among the three axes indicates that the present embodiment is positioned between the first to sixth embodiments and the seventh to twelfth embodiments. In the first to sixth embodiments, the ejection port portion first axis is located close to the heater axis, thus uniformizing the bubbling pressure exerted on the first ejection port portion. The ejection thus becomes relatively stable. On the other hand, in the seventh to twelfth embodiments, the ejection port portion second axis or ejection port portion third axis is located close to the heater axis. Thus, the bubbling pressure generated by the electrothermal conversion element 1 is uniformly transmitted to the second ejection port portion. Consequently, these embodiments are advantageous in that the second ejection port portion can receive relatively high bubbling power generated by the heater. The present embodiment has the advantages of both groups of embodiments. In the present embodiment, each of the first ejection port portion 1316 and the second ejection port portion 1317 is formed like a cylinder.

Fourteenth Embodiment

Now, a fourteenth embodiment in which the present invention is implemented will be described. Components of the fourteenth embodiment similar to corresponding ones of the above-described first to thirteenth embodiments will not be described. Only differences from the first to thirteenth embodiments will be described.

Figure 16A:
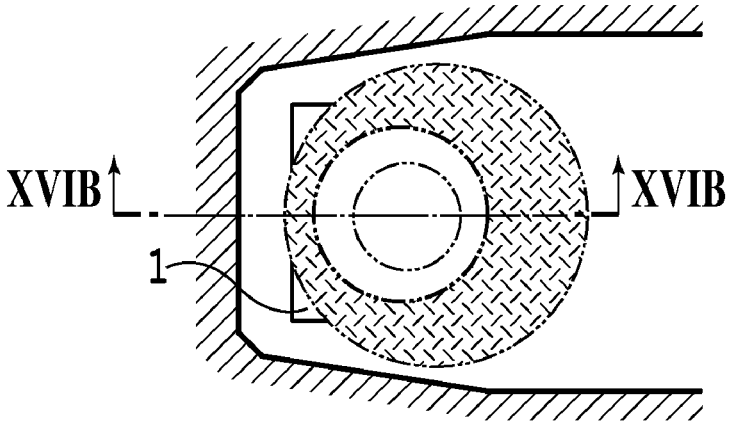
FIG. 16A is an enlarged plan view of a nozzle portion of a print head according to a fourteenth embodiment of the present invention.
Figure 16B:
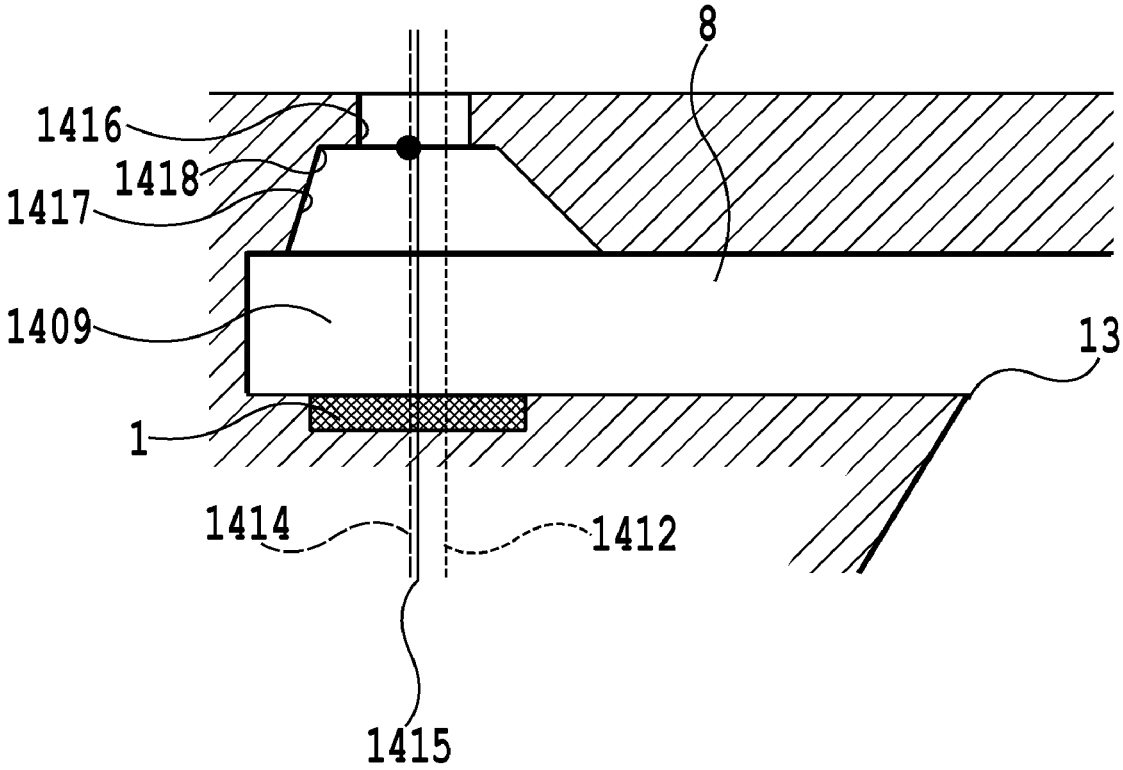
FIG. 16B is a sectional view taken along line XVIB-XVIB in FIG. 16A.

FIG. 16A is a plan view of a nozzle according to the fourteenth embodiment. FIG. 16B is a sectional view of the nozzle in FIG. 16A taken along line XVIB-XVIB. The nozzle shown in FIGS. 16A and 16B is shaped such that a first ejection port portion 1416 is shaped like a cylinder and a second ejection port portion 1417 is shaped like a truncated cone. The second ejection port portion 1417 formed like a truncated cone enables a reduction in flow resistance to ink flows. Furthermore, the tapered side surface of the second ejection port portion 1417 allows the ink to flow smoothly, thus reducing the ink stagnant area. This stabilizes the ejection amount and speed. Consequently, the high quality of print images is maintained. The ink stagnating in the portion 1418 of the second ejection port portion in which the wall surfaces intersect with each other is heated by the electrothermal conversion element and is thus likely to become hotter than the surrounding ink. Thus, such an area is preferably tapered. This is because the ink stagnating in the stagnant area becomes hot, thus possibly varying the viscosity resistance to the ink to be ejected to affect the ejection characteristics.

In the print head shown in FIGS. 16A and 16B, an ejection port portion second axis 1414 passing through the center of gravity of the upper end surface of the second ejection port portion 1417 is located away from an ejection port portion first axis 1412 toward the opposite side of the ink supply port 13. On the other hand, the lower end of the second ejection port portion 1417 is widened toward the ink supply port 13. Since the lower end of the second ejection port portion 1417 is widened toward the ink supply port 13, the distance over which the ink flows from the ink supply port 13 to the ejection port portion is reduced. Furthermore, the refill frequency is improved.

Fifteenth Embodiment

Now, a fifteenth embodiment in which the present invention is implemented will be described. Components of the fifteenth embodiment similar to corresponding ones of the above-described first to fourteenth embodiments will not be described. Only differences from the first to fourteenth embodiments will be described.

Figure 17A:
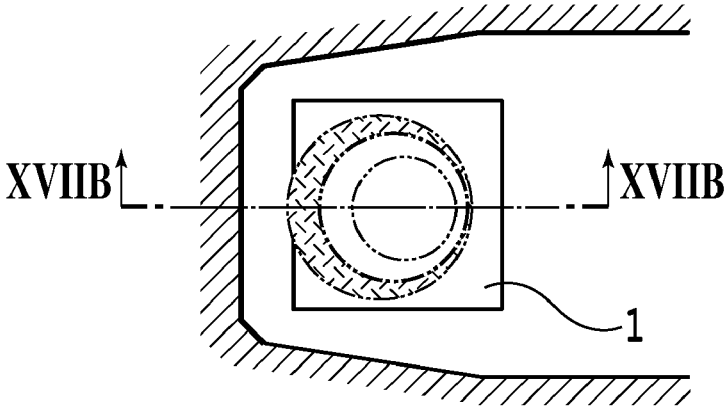
FIG. 17A is an enlarged plan view of a nozzle portion of a print head according to a fifteenth embodiment of the present invention.
Figure 17B:
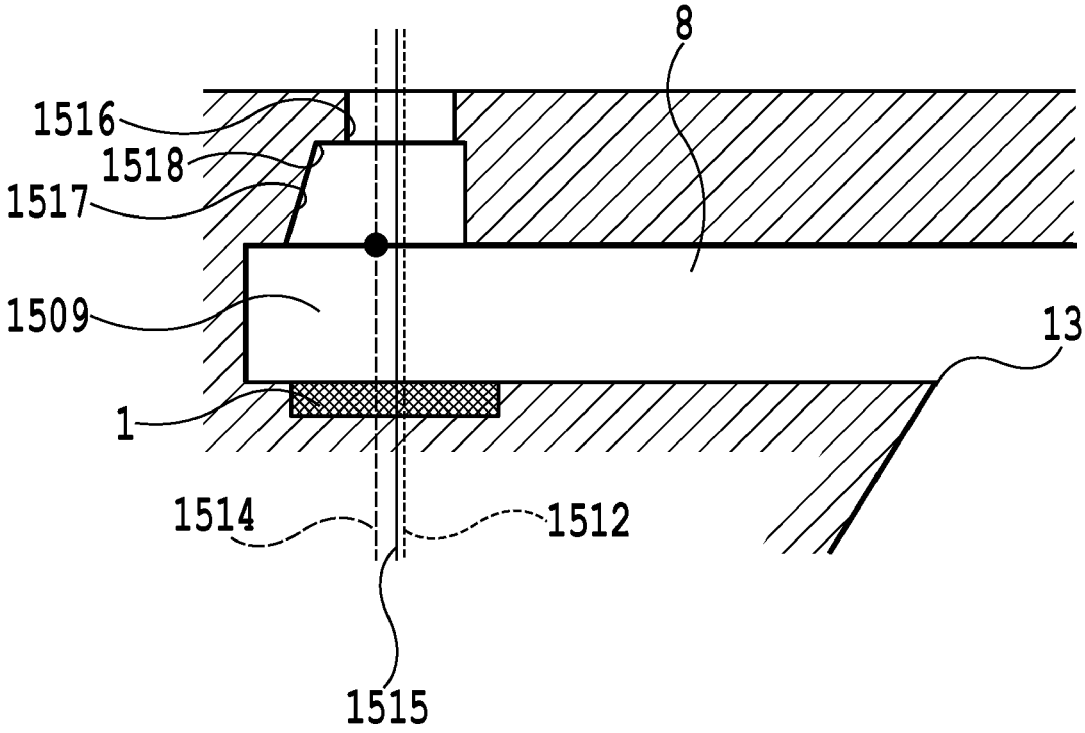
FIG. 17B is a sectional view taken along line XVIIB-XVIIB in FIG. 17A.

FIG. 17A is a plan view of a nozzle according to the fifteenth embodiment. FIG. 17B is a sectional view of the nozzle in FIG. 17A taken along line XVIIB-XVIIB. In the print head shown in FIGS. 17A and 17B, an ejection port portion second axis (not shown in the drawings) passing through a center of gravity of a cross section of the upper end surface of a second ejection port portion 1517 which cross section extends in the orthogonal direction is located away from an ejection port portion first axis 1512 passing through the center of gravity of a cross section of a first ejection port portion 1516 in which the cross section extends in the orthogonal direction. In the present embodiment, in addition, an ejection port portion third axis 1514 passing through the center of gravity of the lower end surface of the second ejection port portion 1517 is located away from the ejection port portion first axis 1512 toward the opposite side of the ink supply port 13. In the present embodiment, the nozzle is formed such that the ejection port portion third axis 1514 passes through the center of gravity of the cross section of the second ejection port portion 1517 which is closer to the lower end thereof (closer to the bubbling chamber) and such that at the position of the above-described cross section, the ejection port portion third axis 1514 is located farther from the ejection port portion first axis 1512. Thus, at the lower end of the second ejection port portion 1517, the maximum flow velocity portion of the ink flow flows through a position located farther from the center of the first ejection port portion 1516. This allows a further reduction in meniscus vibration upon completion of refilling.

Sixteenth Embodiment

Now, a sixteenth embodiment in which the present invention is implemented will be described. Components of the sixteenth embodiment similar to corresponding ones of the above-described first to fifteenth embodiments will not be described. Only differences from the first to fifteenth embodiments will be described.

Figure 18A:
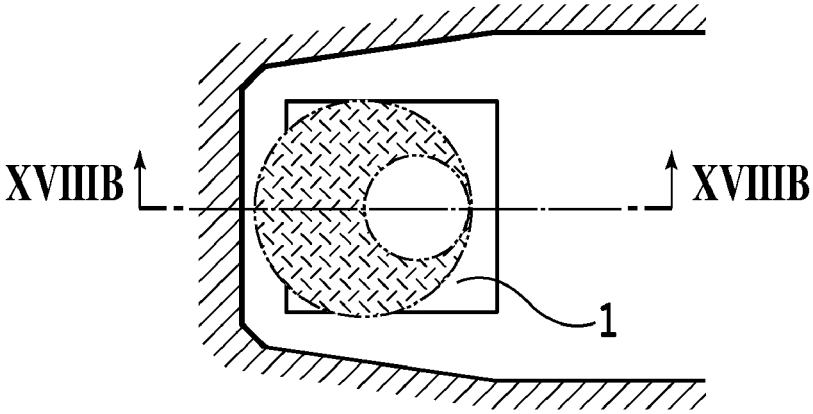
FIG. 18A is an enlarged plan view of a nozzle portion of a print head according to a sixteenth embodiment of the present invention.
Figure 18B:
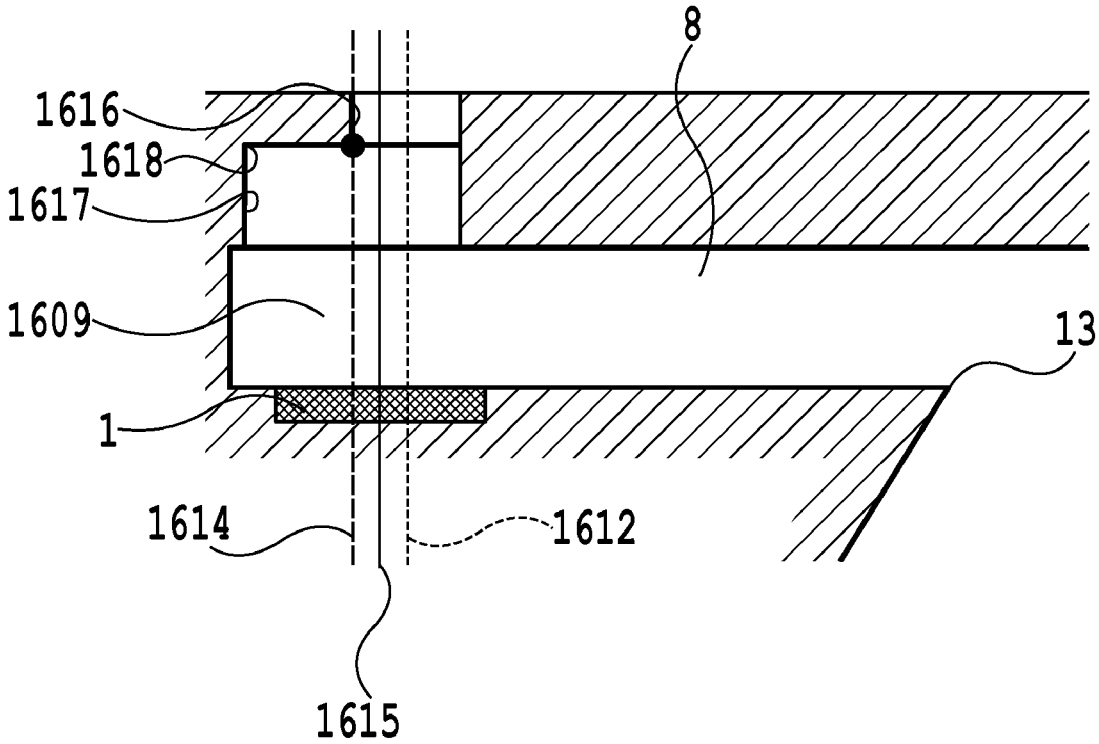
FIG. 18B is a sectional view taken along line XVIIIB-XVIIIB in FIG. 18A.

FIG. 18A is a plan view of a nozzle according to the sixteenth embodiment. FIG. 18B is a sectional view of the nozzle in FIG. 18A taken along line XVIIIB-XVIIIB. The nozzle of the print head shown in FIGS. 18A and 18B is shaped such that a first ejection port portion 1616 and a second ejection port portion 1617 are both formed like a cylinder. The nozzle is formed such that a portion 1618 in which the wall surfaces in the first and second ejection port portions 1616 and 1617 intersect perpendicularly with each other is smaller on the ink supply port 13 side. This results in a relatively small ink stagnant area in the second ejection port portion 1617, thus reducing the effect of a rise in the temperature of the ink.

Seventeenth Embodiment

Now, a seventeenth embodiment in which the present invention is implemented will be described. Components of the seventeenth embodiment similar to corresponding ones of the above-described first to sixteenth embodiments will not be described. Only differences from the first to sixteenth embodiments will be described.

Figure 19A:
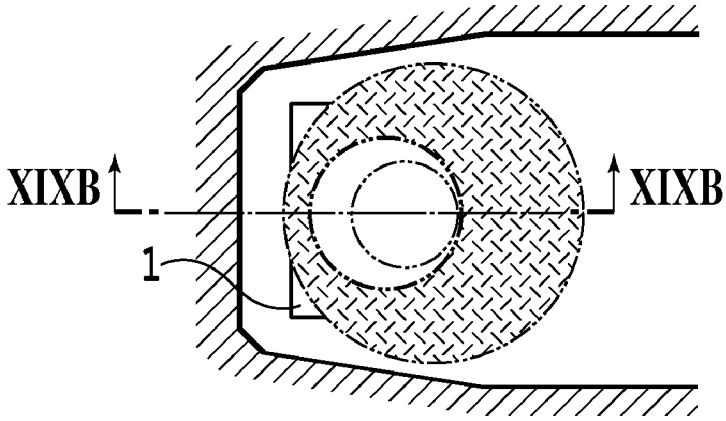
FIG. 19A is an enlarged plan view of a nozzle portion of a print head according to a seventeenth embodiment of the present invention.
Figure 19B:
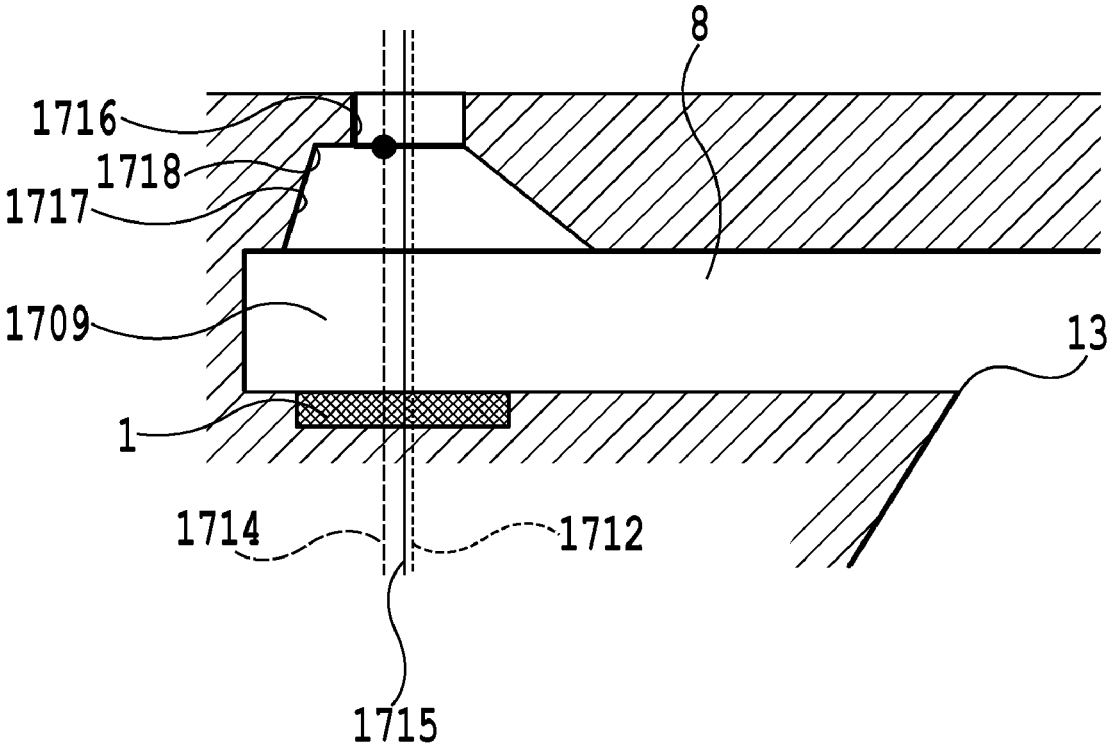
FIG. 19B is a sectional view taken along line XIXB-XIXB in FIG. 19A.

FIG. 19A is a plan view of a nozzle according to the seventeenth embodiment. FIG. 19B is a sectional view of the nozzle in FIG. 19A taken along line XIXB-XIXB. The nozzle shown in FIGS. 19A and 19B is shaped such that a first ejection port portion 1716 is shaped like a cylinder and a second ejection port portion 1717 is shaped like a truncated cone. A portion 1718 in which the wall surfaces in the first and second ejection port portions 1716 and 1717 intersect perpendicularly with each other is not present on the ink supply port 13 side. The second ejection port portion 1717 shaped like a truncated cone reduces the ink stagnant area compared to the second ejection port portion 1717 shaped like a cylinder. This enables inhibition of a rise in the temperature of the ink which is likely to occur in the stagnant area. Furthermore, variation in ejection amount caused by the possible temperature rise can be inhibited, thus, preventing the possible degradation of the quality of print images. Furthermore, the lower end of the second ejection port portion 1717 is widened toward the ink supply port 13. This increases the refill frequency.

Eighteenth Embodiment

Now, an eighteenth embodiment in which the present invention is implemented will be described. Components of the eighteenth embodiment similar to corresponding ones of the above-described first to seventeenth embodiments will not be described. Only differences from the first to seventeenth embodiments will be described.

Figure 20A:
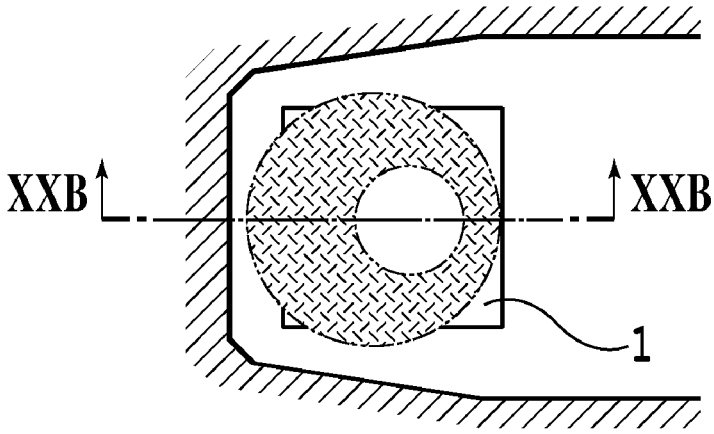
FIG. 20A is an enlarged plan view of a nozzle portion of a print head according to an eighteenth embodiment of the present invention.
Figure 20B:
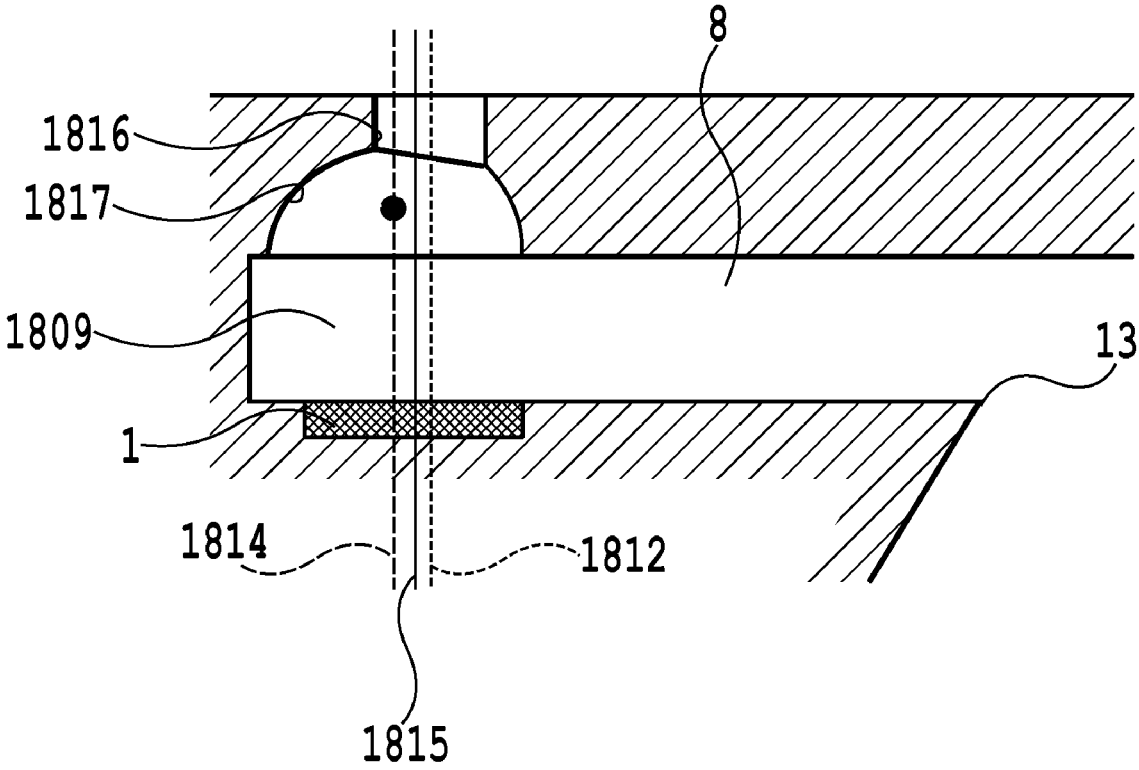
FIG. 20B is a sectional view taken along line XXB-XXB in FIG. 20A.
Figure 21A:
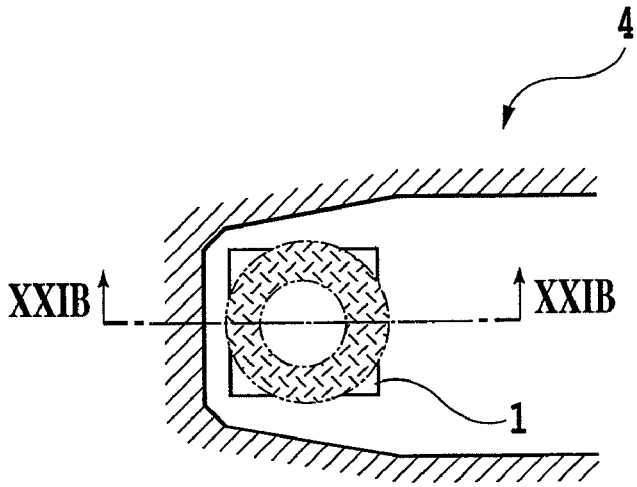
FIG.21A PRIOR ART
FIG. 21A is an enlarged plan view of a nozzle portion of a conventional print head.
Figure 21B:
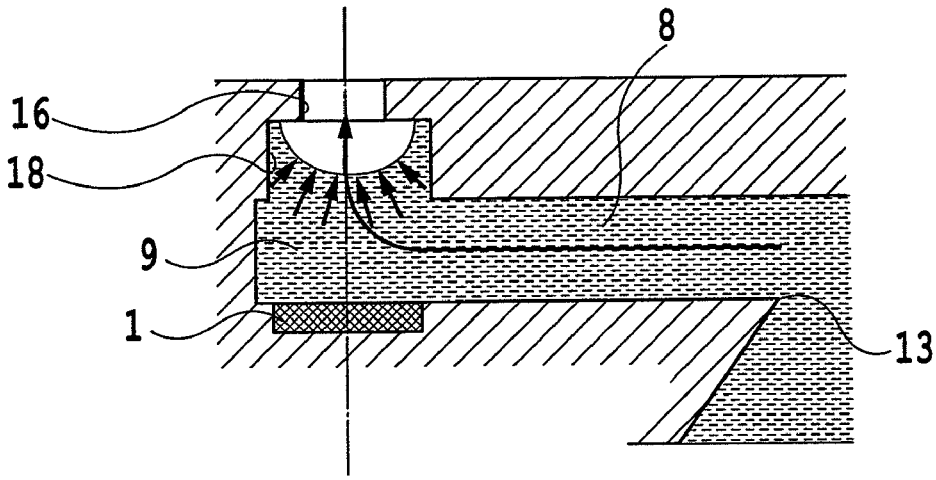
FIG.21B PRIOR ART
FIG. 21B is a sectional view taken along line XXIB-XXIB in FIG. 21A and illustrating an ink flow.

FIG. 20A is a plan view of a nozzle according to the eighteenth embodiment. FIG. 20B is a sectional view of the nozzle in FIG. 20A taken along line XXB-XXB. The nozzle shown in FIGS. 20A and 20B is shaped such that a first ejection port portion 1816 is shaped like a cylinder and a second ejection port portion 1817 is shaped like a part of a sphere. Thus, the second ejection port portion 1817 may be shaped like a sphere or a partly cut oval sphere. The nozzle formed like such shape reduces the stagnant area in the second ejection port portion 1817. Thus, a rise in the temperature of ink which is likely to occur in the stagnant area can be inhibited. This also allows variation in ejection amount caused by the possible temperature rise to be inhibited. Consequently, the possible degradation of the quality of print images can be prevented. Furthermore, in the present embodiment, the nozzle is formed such that an ejection port portion second axis (not shown in the drawings) passing through the center of gravity of a cross section of the second ejection port portion 1817 which is closest to the first ejection port portion in the ejecting direction is located away from an ejection port portion first axis 1812 toward the opposite side of the ink supply port 13. The nozzle is further formed such that an ejection port portion third axis 1814 passing through the center of gravity of a cross section of the second ejection port portion 1817 which is closer to the lower end thereof is located away from the ejection port portion first axis 1812. As the ejection port portion third axis 1814 passing through the center of gravity of the cross section closer to the lower end of the second ejection port portion 1817 is located farther from the ejection port portion first axis 1812, the maximum flow velocity portion of the ink flow flows through a position located farther from the center of the first ejection port portion 1816. Thus, the velocity at which the ink flows into the first ejection port portion 1816 can be reduced. This allows a correspondingly effective reduction in meniscus vibration upon completion of refilling. The cross section of the second ejection port portion 1817 extending in the direction orthogonal to the ink droplet ejecting direction and on which the center of gravity is set need not be the lower end surface. The cross section may correspond to a portion of the second ejection port portion 1817 which is relatively close to the lower end thereof as in the case of the present embodiment.

Other Embodiments

The cross section of each of the first and second ejection port portions which is orthogonal to the ink droplet ejecting direction is not limited to a circle but may be any other shape such as an ellipse or polygon which is enclosed by a curve and is similar to a circle.

Furthermore, the liquid ejection head may be mounted in apparatuses such as a printer, a copier, a facsimile machine with a communication system, and a word processor with a printer portion and in industrial printing apparatuses combined with various processing apparatuses. The liquid ejection head can be used to print various print media such as paper, yarn, fiber, cloth, leather, metal, plastics, glass, woods, and ceramics. The "printing" as used herein means not only applying a meaningful image such as a character or a graphic to a print medium but also applying a meaningless image such as a pattern to a print medium.

Moreover, the "link" or "liquid" should be interpreted in a broad sense. The "ink" or "liquid" refers to a liquid used to form an images or a pattern or to process a print medium or to process ink or a print medium. Here, the processing of ink or a print medium refers to, for example, improvement of the fixability of a color material in ink applied to a print medium based on solidification or insolubilization, or improvement of print quality or coloring capability, or improvement of durability of image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-222769, filed Aug. 29, 2008, which is hereby incorporated by reference herein in its entirety.

What is claimed is:

1. A liquid ejection head comprising:

an energy acting chamber in which a heating element generating heat energy utilized to eject a liquid through an ejection port is arranged, a liquid supply port supplying the liquid to the energy acting chamber through a channel, and an ejection port portion communicating with the energy acting chamber and including the ejection port, wherein the ejection port portion has a first ejection port portion including the ejection port and a second ejection port portion, the first and second ejection port portions having cross-sections extending in a direction orthogonal to an ejecting direction in which the liquid is ejected, cross-sections of the second ejection port portion being larger than those of the first ejection port portion, the second ejection port portion being formed between the energy acting chamber and the first ejection port portion, wherein a first axis extends in the ejection direction and passes through a center of a cross-section of the first ejection port portion, a second axis extends in the ejecting direction and passes through a center of a cross-section of the second ejection port portion, the cross-section located closest to the first ejection port portion in the ejecting direction, and the first axis is offset from the second axis in a direction toward the liquid supply port, and wherein a heat element axis coincides with the first axis, the heat element axis extending in the ejecting direction and passing through a center of a cross-section of the heating element, the cross-section extending in the orthogonal direction.

2. The liquid ejection head according to claim 1, wherein the first axis is located away from a third axis, the third axis passing through a center of a cross-section of the second ejection port portion, the cross-section located closest to the energy acting chamber with respect to the ejecting direction.

3. The liquid ejection head according to claim 1, wherein a heat element axis coincides with the second axis, the heat element axis extending in the ejecting direction and passing through a center of a cross-section of the heating element, the cross-section extending in the orthogonal direction.

4. The liquid ejection head according to claim 1, wherein a heat element axis is positioned between the first axis and the second axis with respect to a direction from the liquid supply port through which the liquid is supplied to the energy acting chamber toward the heating element passing through a center of a cross-section of the heating element, the cross-section extending in the orthogonal direction.

* * * * *